US009851682B2

(12) United States Patent
Aoyama et al.

(10) Patent No.: US 9,851,682 B2
(45) Date of Patent: Dec. 26, 2017

(54) CLEANING BLADE INCLUDING MODIFIED PORTION INCLUDING IMPREGNATED PORTION AND SURFACE LAYER, AND PROCESS CARTRIDGE AND IMAGE FORMING APPARATUS INCLUDING THE CLEANING BLADE

(71) Applicants: Yuka Aoyama, Kanagawa (JP); Masanobu Gondoh, Kanagawa (JP); Yohta Sakon, Kanagawa (JP); Masahiro Ohmori, Kanagawa (JP); Shohei Gohda, Ishikawa (JP); Kaori Toyama, Kanagawa (JP); Yuta Nakamura, Kanagawa (JP); Keiichiro Juri, Kanagawa (JP)

(72) Inventors: Yuka Aoyama, Kanagawa (JP); Masanobu Gondoh, Kanagawa (JP); Yohta Sakon, Kanagawa (JP); Masahiro Ohmori, Kanagawa (JP); Shohei Gohda, Ishikawa (JP); Kaori Toyama, Kanagawa (JP); Yuta Nakamura, Kanagawa (JP); Keiichiro Juri, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 15/183,982

(22) Filed: Jun. 16, 2016

(65) Prior Publication Data

US 2017/0003643 A1 Jan. 5, 2017

(30) Foreign Application Priority Data

Jul. 3, 2015 (JP) ..... 2015-134636
Jan. 13, 2016 (JP) ..... 2016-004569

(51) Int. Cl.
*G03G 21/00* (2006.01)
*G03G 21/18* (2006.01)

(52) U.S. Cl.
CPC ..... *G03G 21/0017* (2013.01); *G03G 21/0011* (2013.01); *G03G 21/18* (2013.01); *G03G 2221/0005* (2013.01)

(58) Field of Classification Search
CPC ..... G03G 21/0017; G03G 21/18; G03G 21/0011; G03G 2221/0005
See application file for complete search history.

(56) References Cited

U.S. PATENT DOCUMENTS 5,450,184 A * 9/1995 Yanai ..... G03G 21/0017 15/256.5
6,060,205 A 5/2000 Takeichi et al.
6,160,977 A 12/2000 Takeichi et al.
2005/0254868 A1 11/2005 Naruse et al.
2008/0219694 A1 9/2008 Nakamori et al.
(Continued)

FOREIGN PATENT DOCUMENTS

JP 9-127846 5/1997
JP 2004-233818 8/2004
(Continued)

OTHER PUBLICATIONS

European search report dated Nov. 15, 2016 in corresponding European Patent Application No. 16176624.1.

*Primary Examiner* — David M Gray
*Assistant Examiner* — Laura Roth
(74) *Attorney, Agent, or Firm* — Cooper & Dunham LLP

(57) ABSTRACT

A cleaning blade includes an elastic member including a contact portion to contact the surface of a member to be cleaned and remove an extraneous matter adhering to the surface of the member. The contact portion includes a modified portion including at least one of an impregnated portion including a first cured material formed of a first curing composition in a thickness direction from the surface of the contact portion; and a surface layer formed of a
(Continued)

second curing composition on the surface of the contact portion. The surface of the modified portion has a tack maximum value not greater than 3.0 [gf/mm$^2$].

9 Claims, 8 Drawing Sheets

(56) References Cited

U.S. PATENT DOCUMENTS

| | | | | |
|---|---|---|---|---|
| 2009/0311017 | A1 | 12/2009 | Ohmori et al. | |
| 2011/0217102 | A1 | 9/2011 | Ohmori et al. | |
| 2013/0189012 | A1 | 7/2013 | Sakon et al. | |
| 2013/0243484 | A1* | 9/2013 | Toda | G03G 21/0017 399/159 |
| 2013/0243507 | A1 | 9/2013 | Sakon et al. | |
| 2013/0251401 | A1 | 9/2013 | Asano et al. | |
| 2014/0178103 | A1* | 6/2014 | Gohda | G03G 15/0233 399/176 |
| 2014/0205338 | A1* | 7/2014 | Gondoh | G03G 21/0017 399/350 |
| 2015/0139711 | A1* | 5/2015 | Gohda | G03G 21/0017 399/350 |
| 2015/0253722 | A1 | 9/2015 | Sakaguchi et al. | |

FOREIGN PATENT DOCUMENTS

| | | |
|---|---|---|
| JP | 2005-164619 | 6/2005 |
| JP | 2010-152295 | 7/2010 |
| JP | 2012-083729 | 4/2012 |
| JP | 2013-076970 | 4/2013 |
| JP | 2014-219529 | 11/2014 |

* cited by examiner

PERIMETER : C1
PARTICLE PROJECTION AREA : S

CIRCLE HAVING AN AREA S
PERIMETER : C2

CLEANING BLADE INCLUDING MODIFIED PORTION INCLUDING IMPREGNATED PORTION AND SURFACE LAYER, AND PROCESS CARTRIDGE AND IMAGE FORMING APPARATUS INCLUDING THE CLEANING BLADE

CROSS-REFERENCE TO RELATED APPLICATIONS

This patent application is based on and claims priority pursuant to 35 U.S.C. §119 to Japanese Patent Applications Nos. 2015-134636 and 2016-004569, filed on Jul. 3, 2015 and Jan. 13, 2016, respectively in the Japan Patent Office, the entire disclosure of which is hereby incorporated by reference herein.

BACKGROUND

Technical Field

The present invention relates to a cleaning blade, a process cartridge and an Image forming apparatus.

Description of the Related Art

Conventionally, in electrophotographic image forming apparatuses, extraneous matters such as unnecessary residual toners after toner images are transferred to transfer papers and intermediate transferers, which adhere to the surfaces of image bearers (hereinafter referred to as "photoconductors", "electrophotographic photoconductors" and "electrostatic latent image bearers") to be cleaned are removed by cleaners.

As a cleaning member of the cleaner, a strip-shaped cleaning blade is well known because of having simple constitution and good cleanability. A base end of the cleaning blade is fixed on a rigid holder and an edge ridgeline thereof is pressed against the circumferential surface of the image bearer to data and scrape off a toner remaining on the image bearer.

Further, an almost spherical polymerization toner having a small particle diameter has been used in image forming apparatuses recently to produce high quality images. The polymerization tuner has higher transferability than conventional pulverization tuners. However, the polymerization toner is difficult to fully remove from the surface of the image bearer, resulting, in poor cleaning. This is because the spherical polymerization toner having a small particle diameter scrapes from the narrowest gap between the blade and the image bearer.

A contact pressure between the image bearer and the cleaning blade needs increasing to prevent the toner from scraping front the gap. However, when the contact pressure is increased, a friction between an image bearer 123 and a cleaning blade 62 in FIG. 7A increases, the cleaning blade 62 is drawn in a travel direction of the image bearer 123, and an edge 62*c* of the cleaning blade 62 turns over. The cleaning blade 62 turned over occasionally makes noises when restored to its original state, resisting turning over. Further, when the cleaning continues while the edge 62*c* of the cleaning blade 62 is turned over, a local abrasion is made a few μm from the edge 62*c* of an proximal face 62*a* of the cleaning blade 62 as shown in FIG. 7B. When the cleaning continues further, the local abrasion becomes large and finally the edge 62*c* is chipped as shown in FIG. 7C. When the edge 62*c* lacks, a toner cannot normally be removed, resulting in poor cleaning. 62*b* in FIGS. 7A to 7C is an undersurface of the cleaning blade.

SUMMARY

A cleaning blade includes an elastic member including a contact portion to contact the surface of a member to be cleaned and remove an extraneous matter adhering to the surface of the member. The contact portion includes a modified portion including at least one of an impregnated portion including a first cured material formed of a first curing composition in a thickness direction from the surface of the contact portion; and a surface layer formed of a second curing composition on the surface of the contact portion. The surface of the modified portion has a tack maximum value not greater than 3.0 [gf/mm$^2$].

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION

Figure 1A:
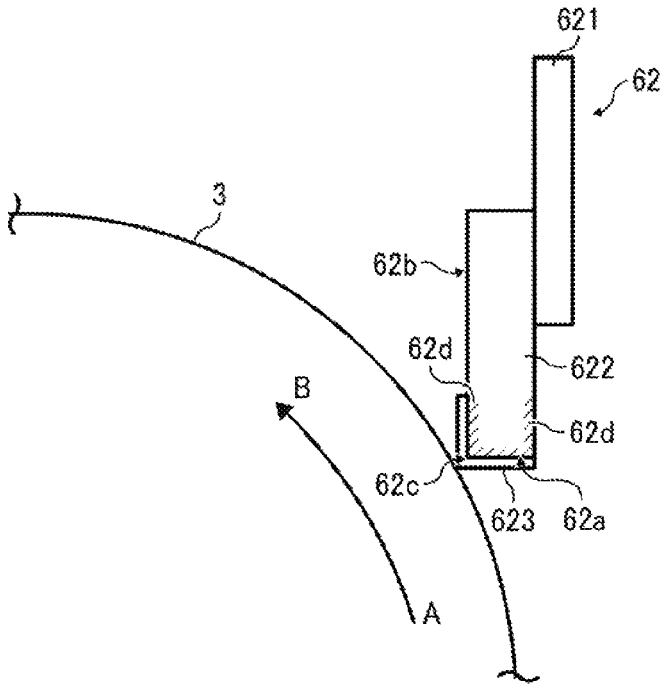
FIG. 1A is an enlarged cross-sectional view illustrating a cleaning blade contacting the surface of an image bearer.

Accordingly, one object of the present invention is to provide a cleaning blade capable of suppressing generation of abnormal noises due to turned over edge ridgeline and abnormal abrasion, maintaining good cleanability for long periods, and preventing color registration errors in tandem image forming methods.

Another object of the present invention is to provide an image forming apparatus using the cleaning blade.

A further object of the present invention is to provide a process cartridge using the cleaning blade.

Exemplary embodiments of the present invention are described in detail below with reference to accompanying drawings. In describing exemplary embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In the present invention, a longitudinal direction surface of a substrate forming the elastic member, facing a downstream side in the travel direction of a member to be cleaned is an undersurface of the substrate. A surface including an edge ridgeline of the substrate and facing an upstream side in the travel direction of the member to be cleaned is an edge surface of the substrate.

A longitudinal direction surface of the elastic member, facing the downstream side in the travel direction of the member to be cleaned is a blade undersurface. An edge surface including an edge ridgeline of the elastic member and facing the upstream side in the travel direction of the member to be cleaned is a blade edge surface.

In FIG. 1A, a surface 62*b* facing the downstream side B in the travel direction of the member to be cleaned is the blade undersurface. An edge surface 62*a* facing the upstream side A in the travel direction of the member to be cleaned is the blade edge surface.

The contact portion of the elastic member contacting the surface of the member to be cleaned include the edge ridgeline of the elastic member. When the edge ridgeline is turned over or a liner pressure is high, a part of the blade edge surface can be a contact portion.

In the present invention, when the surface of the modified portion of the cleaning blade has a tack maximum value not greater than 3.0 [gf/mm$^2$], turning over the edge ridgeline can be prevented, an excessive stick slip can be suppressed, and a load of the member to be cleaned when starting moving can be reduced. This suppresses turning over and abrasion of the blade, maintains good cleanability for long periods, and prevents color registration errors in tandem image forming methods.

The tack maximum value is more preferably from 0.05 to 1.2 [gf/mm$^2$] for the cleaning blade to have sufficient contactless needed to remove extraneous matters adhering to a member to be cleaned and avoid defective cleaning. The cleaning blade does not need high contact pressure, and is not easily abraded to avoid defective cleaning. Further, turning over the edge ridgeline and an excessive stick slip can sufficiently be suppressed.

When the surface of the modified portion is a surface layer, formation of the layer such as surface roughness and thickness can be controlled by properly changing conditions of spray process such as concentration of solid contents of the coating liquid, spray quantity, a distance from the spray, a spray moving speed and times of spray coating. Controlling these conditions can make a tack maximum value of the surface not greater than 3.0 [gf/mm$^2$].

When the surface of the modified portion is an impregnated portion, formation thereof (roughness) can be controlled by properly changing impregnating materials, impregnating time, concentration of solid contents of the impregnating liquid, a washing process of the extra liquid after impregnating and washing liquids. This can make a tack maximum value of the surface not greater than 10 [gf/mm$^2$].

Low inner tackiness of the modified portion of the elastic member can suppress turning over and excessive stick slip to maintain good cleanability for long periods and prevent color registration errors m tandem image forming methods.

The inner tack maximum value is preferably not greater than 6.0 [gf/mm$^2$], and more preferably from 0.05 to 3.0 [gf/mm$^2$] at the depth of 5 μm from the surface of the modified portion of the blade undersurface.

The tack maximum value is measured by a tacking tester TAC-II from Rhesca Corp.

A SUS probe having a diameter of 5 mm or 8 mm was used in measurement at load of 200 g, a pressing time of 2 sec, a drawing speed of 600 mm/min and a temperature of 23° C. The blade undersurface of the elastic member was measured and the edge ridgeline is the end of the probe position.

Figure 11:
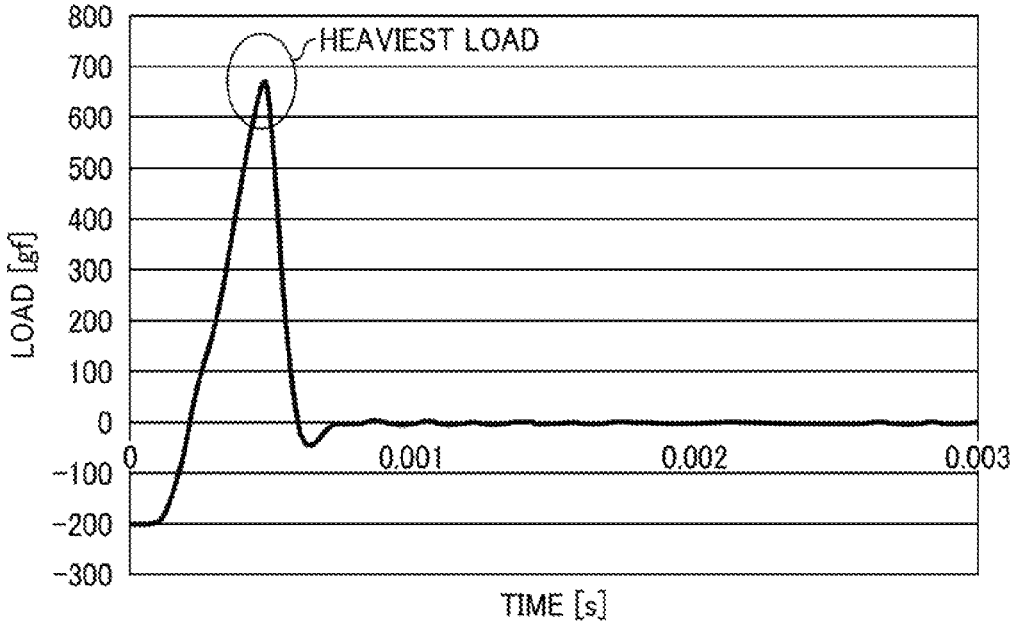
FIG. 11 is a diagram of an example of profile of measuring the tack maximum value.

The probe is pressed against a sample at a specific load, when the probe is separated from the sample at specific speed, a resistance the probe receives from the sample due to an adhesive power is measured as a load value. The highest load value when the probe is separated from the sample is divided by an area of the probe to determine the tack maximum value. FIG. 11 is a diagram of a typical profile of measuring the tack maximum value.

In the present invention, the tack maximum value is measured three times and an average is a tack maximum value of the sample.

As for the tack maximum value of the surface of the modified portion of the cleaning blade, when the modified portion is smaller than the probe diameter, the tack maximum value only of the surface of the modified portion cannot be measured. If possible, a sample including a modified portion having a diameter larger than the probe diameter is prepared to measure. When such samples cannot be prepared, the measurement result may be the tack maximum value of the surface of the modified portion if about a half or more of the probe contacts the modified portion.

The inner surface at the depth of 5 μm of the modified portion of the blade undersurface can be exposed with a Cryo-Microtome using a diamond knife Cryo Dry.

Figure 6A:
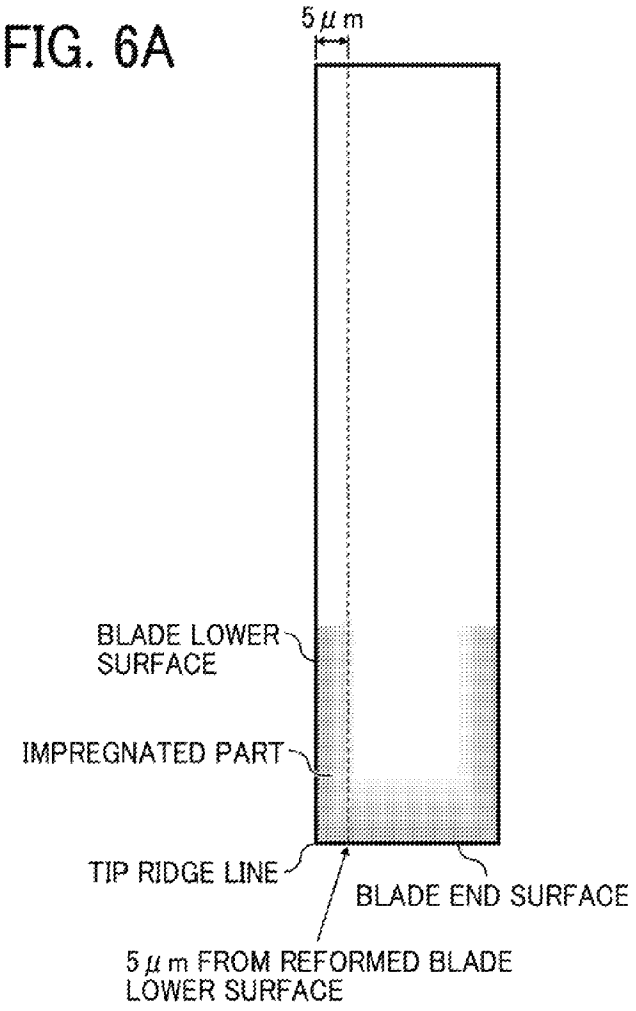
FIG. 6A is an explanatory drawing for explaining an inside at the depth of 5 μm from the blade undersurface of an elastic member.
Figure 6B:
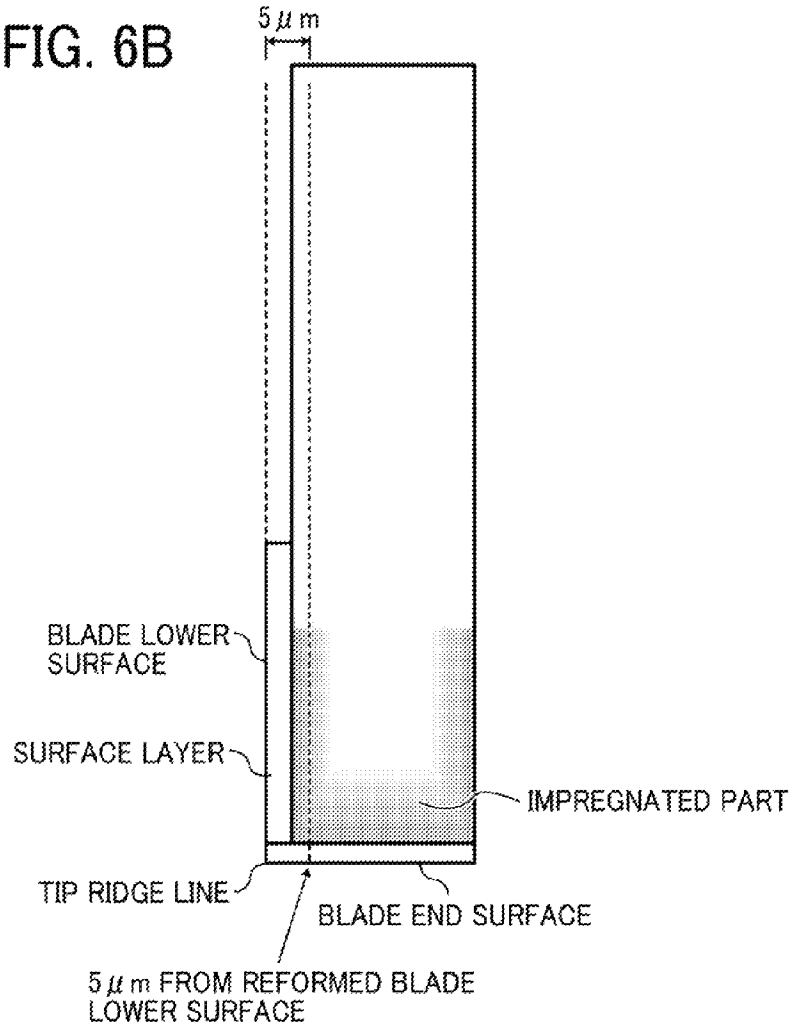
FIG. 6B is an explanatory drawing for explaining an inside at the depth of 5 μm from the blade undersurface of an elastic member.

FIGS. 6A and 6B are examples of an exposed inside at the depth of 5 μm from the blade undersurface. The modified portion in FIG. 6A is only an impregnated portion, and FIG. 6B further includes a surface layer.

After the inner surface is exposed, the tack maximum value was measured at a position where the end of the probe is fitted to the edge ridgeline as the tack maximum value of the surface of the modified portion was measured.

Figure 1B:
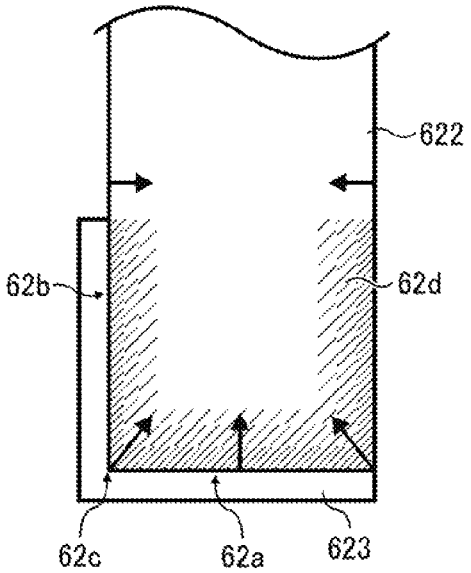
FIG. 1B is an enlarged view illustrating a vicinity of the contact portion of the cleaning blade.
Figure 2:
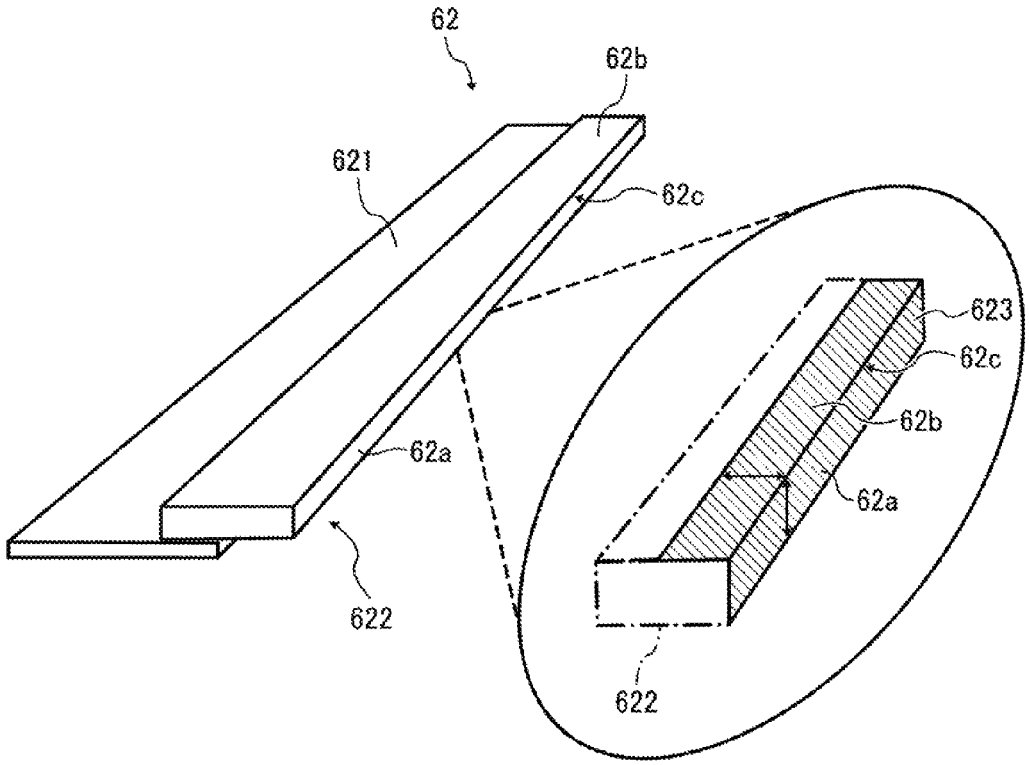
FIG. 2 is a perspective view illustrating an embodiment of the cleaning blade of the present invention.

FIG. 2 is a perspective view illustrating a cleaning blade 62. FIGS. 1A and 1B are enlarged cross-sectional views illustrating the cleaning blade 62. FIG. 1A, is an explanatory view of the cleaning blade 62 contacting the surface of a photoconductor 3. FIG. 1B is an enlarged view illustrating a vicinity of the contact portion including an edge ridgeline 62*c* of an elastic member 622 of the cleaning blade 62.

A substrate formed of a urethane rubber of the elastic member 622 of the cleaning blade 62 is impregnated with a first curing composition by dip coating. Further, after a surface layer 623 is formed with a second curing composition by spray coating, a resin included in the second curing composition is cured by UV irradiation or heating.

After the first curing composition is impregnated in the substrate, the first curing composition may be irradiated with US or heated before the surface layer 623 is formed. After the first curing composition is impregnated in the urethane rubber as the substrate of the elastic member 622, the surface layer 623 is formed with the second curing composition after the first curing composition is cured by UV irradiation or heating. Even when the surface layer 623 is formed with the second curing composition after the first curing composition is fixed on the urethane rubber, the impregnated state does not change and the elastic member 622 is desiredly impregnated.

The first curing composition is impregnated in the contact portion of the elastic member 622 by brash coating, spray coating or dip coating.

A curing resin monomer is impregnated in a substrate such as polyurethane to obtain low tackiness of the surface including an inside at the depth of 5 μm from the surface of the blade undersurface of the modified portion. The curing resin monomer, a polymerization initiator, a curing method, a concentration of solid contents of a coating liquid, a concentration of the polymerization initiator in the coating liquid, an impregnating time, a washing process of a residual resin on the surface of the blade after impregnated, formation of the surface layer, etc. change the inner tack maximum value. When the impregnation is high (long impregnating timer, a solvent of the impregnating liquid, washing) and a curing rate is high (a concentration of the polymerization initiator, cumulative UV, UV irradiating atmosphere), the inner tack maximum value is small.

The surface layer 623 is formed by coating an edge ridgeline 62*c* of the cleaning blade 62 with the second caring composition by spray coating, dip coating or screen printing after the substrate of the elastic member 622 is impregnated with the first curing composition and air dried for a predetermined time.

The surface layer 623 is preferably formed by coating with the second curing composition forming a cured material having a Martens hardness higher than that of the substrate of the elastic member 622 to have a thickness of from 0.3 to 5.0 μm, and more preferably from 0.8 to 2.5 μm. Therefore, the surface layer 623 is so rigid as to suppress the edge ridgeline 62*c* of the cleaning blade 62 from turning over.

After the curing composition is impregnated or the surface layer 623 is formed, tis is irradiated with UV or heated to form an impregnated portion 62*d* as shown in FIG. 1B, which increases hardness of the edge ridgeline 62*c* (contact portion).

The surface layer 623 harder than the substrate of the elastic member 622 is preferably thrilled on the surface including the contact portion to have a thickness of from 0.3 to 5.0 μm.

The edge ridgeline 62*c* of the elastic member 622 including the surface layer 623 and/or the impregnated portion 62*d* has a Martens hardness of from 1.0 to 15.0 [N/mm$^2$] on the surface 20 μm from the edge ridgeline.

The surface 20 μm from the edge ridgeline of the elastic member preferably has a Martens hardness of from 10 to 15.0 [N/mm$^2$]. The elastic member has flexibility of the substrate rubber and suitable hardness to keep followability of the vicinity of the contact portion to microscopic waves of an image bearer and prevent the edge ridgeline from turning over. The edge ridgeline is not abraded due to turning over and the cleaning blade can maintain cleanability. The surface 20 μm from the edge ridgeline of the elastic member more preferably has a Martens hardness of from 1.2 to 7.0 [N/mm$^2$].

The Martens hardness is measured by a microscopic hardness meter HM-2000 from Fischer Instruments is used, in which Vickers indenter is pushed into an object at 1.0 mN for 10 sec, held for 5 sec, and drawn at 1.0 mN for 10 sec.

In order to decrease tackiness of the cleaning blade, the spray conditions of forming the surface layer are changed to control the surface roughness of the surface layer.

The blade undersurface of the modified portion of the elastic member preferably has a surface roughness Ra of from 0.20 to 1.00 μm.

An embodiment of the edge ridgeline 62*c* of the elastic member 622 including the impregnated portion and the surface layer has been explained. The present invention is not limited thereto. The edge ridgeline 62*c* of the elastic member 622 may include only the impregnated portion or the surface layer.

<Member to be Cleaned>

The members to be cleaned are not particularly limited in materials, shapes, structures and sizes, and can be selected according to purposes. The shapes of a drum, a belt, a plate, a sheet, etc. can be used. The sizes are not particularly limited, and can be selected according to purposes. Appropriate sizes are preferably used.

The materials are not particularly limited, and can be selected according to purposes. Metals, plastics, ceramics, etc, can be used.

When the cleaning blade is used in an image forming apparatus, the member to be cleaned includes an image bearer, etc.

<Extraneous Matters>

The extraneous matters are not particularly limited, and can be selected according to purposes if they adhere to the members to be cleaned and to be removed by the cleaning blade. Specific examples thereof include toners, lubricants, inorganic fine particles, organic fine particles, dusts or their mixtures. Among these, toners are preferable, and low-temperature fixable toners having a glass transition temperature not higher than 50° C. are more preferable.

<Substrate>

The cleaning, blade of the present invention is preferably formed of a substrate and a plate-shaped elastic member having an end connected with the substrate and a free end having a predetermined length at the other end. The cleaning blade is located such that the contact portion including the edge ridgeline which is the free end of the elastic member contacts the surface of the member to be cleaned along its longitudinal direction.

The substrate is not particularly limited in materials, shapes, structures and sizes, and can be selected according to purposes. The shapes of a plate, a strip, a sheet, etc, can be used. The sizes are not particularly limited, and can be selected according to purposes. An appropriate size according to the size of the member to be cleaned is used.

Specific examples of the materials include metals, plastics, ceramics, etc. Among these, metallic plates are preferably used in terms of strength. Steel plates such as stainless steel, aluminum plates and phosphor-bronze plates are more preferably used.

<Elastic Member>

The elastic member 622 is not particularly limited in materials, shapes, structures and sizes, and can be selected according to purposes. The shapes of a plate, a strip, a sheet, etc. can be used. The sizes are not particularly limited, and can be selected according to the size of the member to be cleaned.

A substrate of the elastic member 622 is not particularly limited, and can be selected according to purposes. Polyurethane rubbers, polyurethane elastomers, etc. are preferably used.

Methods of preparing the substrate of the elastic member is not particularly limited, and can be selected according to purposes. For example, a polyurethane prepolymer is prepared with a polyol compound and a polyisocyanate compound. A curing agent, and a curing catalyst when necessary are added to the polyurethane prepolymer to be crosslinked in a predetermined die. The crosslinked is burned in an oven and molded to have the shape of a sheet by centrifugal molding. After the resultant sheet-shaped material is left at room temperature and aged, it is cut to have the shape of a plate.

The polyol compounds is not particularly limited, and can be selected according purposes. For example, polymeric polyols and low-molecular-weight polyols.

Specific examples of the polymeric polyols include polyester polyol which is a condensation body with alkylene glycols and aliphatic dibasic acids; polyester polyols of alkylene glycols and adipic acids such as ethylene adipate ester polyol, butylene adipate ester polyol, hexylene adipate ester polyol, ethylene propylene adipate ester polyol, ethylene butylene adipate ester polyol, ethylene neopentylene adipate ester polyol; polycaprolactone polyols such as the polycaprolactone ester polyol obtained by subjecting caprolactone to ring-opening polymerization; and polyether polyols such as poly(oxytetramethylene) glycol and poly(oxypropylene) glycol; etc. These may be used alone or in combination.

Specific examples of the low-molecular-weight polyols include dihydric alcohols such as 1,4-butanediol, ethylene glycol, neopentylglycol, hydroquinone bis(2-hydroxyethyl) ether, 3,3'-dichloro-4,4'-diaminodiphenylmethane and 4,4'-diaminodiphenyl methane; and tri- or higher valent polyols such as 1,1,1-trimethylol propane, glycerin, 1,2,6-hexanetriol, 1,2,4-butanetriol, trimethylolethane, 1,1,1-tris(hydroxy ethoxymethyl) propane, diglycerine, pentaerythritol. These may be used alone or in combination.

Specific examples of the polyisocyanate compounds include, but are not limited to, methylene diphenyl diisocyanate (MDI), avian range isocyanate xylylene diisocyanate (XDI), naphthylene, 1,5-diisocyanate (NDI), tetramethyl xylene diisocyanate (TMXDI), isophorone diisocyanate (IPDI), hydrogenation xylylene diisocyanate (H6XDI), dicyclobexyl methane diisocyanate (H12MDI), hexamethylene diisocyanate dimer acid diisocyanate (DDI), norbornene diisocyanate (NBDI), trimethyl hexamethylene diisocyanate (TMDI). These may be used alone or in combination.

The curing catalyst is not particularly limited, and can be selected according purposes. For example, 2-methylimidazole, 1,2-dimethylimidazole, etc. can be used.

The content thereof is not particularly limited, and can be selected according purposes. It is preferably from 0.01% to 0.5% by mass, and more preferably from 0.05% to 0.3% by mass.

A JIS-A hardness of the substrate is not particularly limited, and can be selected according purposes. It is preferably not less than 60°, and more preferably from 65° to 80° to obtain blade linear pressure, and not to enlarge an area between an image bearer and the contact portion. Therefore, defective cleaning is suppressed.

The JIS-A hardness of the substrate can be measured by. Micro durometer MD-1 from KOBUNSHI KEIKI CO., LTD.

A repulsive elasticity of the substrate can be measured by e.g., a resilience tester No. 221 from Toyo Seiki Seisakusho, Ltd. according to JIS K6255 at 23° C.

A thickness of the substrate is not particularly limited, and can be selected according purposes. It is preferably from 1.0 to 3.0 μm.

<Modified Portion>

"The contact portion of the elastic member contacting the surface of the member to be cleaned includes a modified portion formed of a curing composition" means the end ridgeline 62*c* contacting the image bearer is modified. The modified portion may be included inside of the end ridgeline 62*c*. When a surface layer is formed covering the end ridgeline 62*c*, the modified portion is included inside of the end ridgeline 62*c*. When a surface layer is formed on the end ridgeline 62*c*, the modified portion is included inside thereof as well. Materials forming the modified portion may be included in portions besides the end ridgeline 62*c* of the elastic member 622 if at least the end ridgeline 62*c* of the elastic member 622 includes the materials forming the modified portion.

The cleaning blade 62 of the present invention preferably includes the impregnated portion 62*d* as the modified portion to highly harden the end ridgeline 62*c* of the elastic member 622.

Even when the abrasion of the contact portion of the elastic member is progressed, high hardness inside of the vicinity of the surface layer is maintained for long periods. Therefore, good cleanability can be maintained.

<Impregnated Portion>

The contact portion of the elastic member 622 contacting the surface of the member to be cleaned preferably includes a cured material formed of a first curing composition from the surface of the contact portion in its thickness direction. "including a cured material formed of a first curing composition from the surface of the contact portion in its thickness direction" means the cured material is included inside as well as at the surface of the contact portion. The cured material is included inside even when a surface layer is formed on the contact portion.

The cured material formed of the curing composition may be included in portions besides the contact portion of the elastic member if at least the contact portion thereof includes the cured material formed of the curing composition. The portions the cured material formed of the curing composition may be included in include the blade undersurface, the entire blade edge surface and the backside of the blade undersurface, etc.

<Curing Composition>

The curing composition is a material forming a cured material (solid polymer) formed of monomers and oligomers applied with an energy such as light and heat to be polymerized and cured. Energy sources depend on initiators generating active species such as radical, ion, acid and base starting polymerization and stimulations (electron beam), and specific examples of the curing compositions include UV curing compositions, heat curing compositions and electron beam curing compositions.

Photoinitiators are used for the UV curing compositions and the electron beam curing compositions. UV or electron beam is irradiated to initiate a curing reaction classified to radical, cation or anion polymerization. A polymerization reaction such as vinyl polymerization, vinyl copolymerization, ring-opening polymerization or addition polymerization generates a cured materials.

Heat polymerization initiators are used for the heat curing compositions. The heat polymerization initiators are heated to initiate curing reaction. Polymerization motions such as isocyanate, radical polymerization, epoxy ring-opening polymerization and melamine condensation generate cured materials.

The cured materials are not particularly limited, and can be selected according to purposes. For examples, acrylic resins, phenol resins, urethane resins, epoxy resins, silicone resins, amino resins, etc. can be used. (Meth)acrylic resins are preferably used in terms of hardness.

<<First Curing Composition>>

The first curing composition is preferably a UV curing composition.

The UV curing composition preferably includes a (meth) acrylic compound, and other components when necessary.

The (meth)acrylic compound is not particularly limited, and can be selected according to purposes. A (meth)acrylic compound having an alicyclic structure in its molecule is preferably used.

—(Meth)acrylic Compound having an Alicyclic Structure in Molecule—

The (meth)acrylic compound having an alicyclic structure in its molecule has a few functional groups because of having a bulky specific alicyclic structure in its molecule. The (meth)acrylic compound having a low molecular weight can be used, which is easily be impregnated in the contact portion of the elastic member to efficiently improve hardness of the contact portion.

The alicyclic structure of the (meth)acrylic compound having an alicyclic structure in its molecule preferably has not less than 6 carbon atoms, and more preferably from 6 to 12 carbon atoms. When not less than 6 carbon atoms, the contact portion does not have lower hardness. When not greater than 12 carbon atoms, there is no steric hindrance.

The (meth)acrylic compound having an alicyclic structure having not less than 6 carbon atoms in its molecule preferably has not less than 2 functional groups, more preferably from 2 to 6, and furthermore preferably from 3 to 4 functional groups. When not less than 2 functional groups, the contact portion does not have lower hardness. When not greater than 6 functional groups, there is no steric hindrance.

The (meth)acrylic compound having an alicyclic structure in its molecule preferably has a molecular weight not greater than 200. When not greater than 200, the (meth)acrylic compound is easily impregnated in the elastic member to have higher hardness.

A (meth)acrylic compound having a tricyclodecane structure or an adamantane structure is preferably used as the (meth)acrylic compound having an alicyclic structure in its molecule because of being capable of covering, a shortage of crosslinking points with a specific cyclic structure even when functional groups are few.

The (meth)acrylic compound having a tricyclodecane structure is not particularly limited, and can be selected according to purposes. For example, tricyclodecane dimethanol diacrylate, tricyclodecane dimethanol dimethacrylate, etc. can be used.

Properly synthesized or marketed (meth)acrylic compound having a tricyclodecane structure may be used. Specific examples of the marketed (meth)acrylic compound having a tricyclodecane structure include A-DCP from Shin-Nakamura Chemical Co., Ltd., etc.

The (meth)acrylic compound having an adamantane structure is not particularly limited, and can be selected according to purposes. For example, 1,3-diadamantanedimethanoldiacrylate, 1,3-diadamantanedimethanoldimethacrylate, 1,3,5-admanatanetrimethanotriacrylate, 1,3,5-admanatanetrimethanoltrimethacrylate, etc. can be used.

Properly synthesized or marketed (meth)acrylic compound having an adamantane structure may be used. Specific examples of the marketed (meth)acrylic compound having an adamantane structure include X-DA from Idemitsu Kosan Co., Ltd., X-A-201 from Idemitsu. Kosan Co., Ltd., and ADTM from Mitsubishi Gas Chemical Company, Inc., etc.

The content of the (meth)acrylic compound having an alicyclic structure in its molecule is not particularly limited, and can be selected according to purposes. The solid content thereof is preferably from 20% to 100% by mass, and more preferably from 50% to 100% by mass relative to 100% by mass of the first curing composition. When not less than 20% by mass, high hardness due to the specific cyclic structure is not impaired.

The (meth)acrylic compound having an alicyclic (particularly tricyclodecane) structure in its molecule included in the contact portion of the elastic member contacting the surface of the member to be cleaned can be analyzed with an infrared microscope or a liquid chromatography.

The first curing composition may include a (meth)acrylic compound having a molecular weight of from 100 to 1,500 or a fluorine (meth)acrylic compound besides the (meth) acrylic compound having an alicyclic structure in its molecule.

Specific examples of the (meth)acrylic compound having a molecular weight of from 100 to 1,500 include, but are not limited to, dipentaerythritol hexa(meth)acrylate, pentaerythritol tetra(meth)acrylate, pentaerythritol tri(meth)acrylate, pentaerythritol ethoxy tetra(meth)acrylate, trimethylol propane tri(meth)acrylate, ditrimethylol propane tetra(meth) actylate, trimethylol propane ethoxy tri(meth)acrylate, 1,6-hexanediol di(meth)acrylate, ethoxylated bisphenol A di(meth)aetylate, propoxylated ethoxylated bisphenol A di(meth)acrylate, 4-butanediol di(meth)acrylate, 1,5-pentartediol di(meth)acrylate, 1,6-hexanedial di(meth)acrylate, 1,7-heptanediol di(meth)acrylate, 1,8-octanediol di(meth) acrylate, 1,9-nonanediol di(meth)acrylate, 1,10-decanediol di(meth)acrylate, 1,11-undecanedioldi(meth)acrylate, 1,18-octadecanediol di(meth)acrylate, glycerin propoxy tri(meth) acrylate, dipropylene, glycol di(meth)aclate, tripropylene glycol di(meth)acrylate. PO-modified neopentylglycol di(meth)acrylate, PEG600 di(meth)acrylate, PEG400 di(meth)acrylate, PE G200 di(meth)acrylate, neopentylglycol hydroxy pivalic acid ester di(meth)acrylate, octyl/decyl (meth)acrylate, isobornyl(meth)acrylate, ethoxylated phenyl (meth)acrylate, and 9,9-bis[4-(2-(meta) actyloyl oxy ethoxy) phenyl] fluorene. These may be used alone or in combination. Among these, a compound having a pentaerythritol triacrylate structure having 3 to 6 functional groups is preferably used.

Specific examples of the compound having a pentaerythritol triacrylate structure having 3 to 6 functional groups include pentaerythritoltriacrylate, dipentaerythritolhexaactylate, etc.

The fluorine (meth)acrylic compound preferably has a perfluoropolyether skeleton, and more preferably has a perfluoropolyether skeleton and two or more function groups.

Specific examples of the fluorine (meth)acrylic compound include, but are not limited to, 2,2,2-trifluoro ethyl acrylate, 2,2,2-trifluoroethyl methacrylate, 2,2,3,3-tetrafluoropropyl acrylate, 2,2,3,3-tetrafluoropropyl methacrylate, 2,2,3,3,4,4,4-heptafluorobutyl acrylate, 2,2,3,3,4,4,4-heptafluorobutyl methacrylate, 2,2,3,4,4,4-hexafluorobutyl acrylate, 2,2,3,4,4,4-hexafluorobutyl methacrylate, 1,1,1,3,3,3-hexafluoroisopropyl acrylate, 1,1,1,3,3,3-hexafluoroisopropyl methacrylate, 1H, 1H, 5H-octafluoropentyl acrylate, 1H, 1H, 5H-octafluoropentyl methacrylate, 2,2,3,3,3-pentafluoropropyl acrylate, 2,2,3,3,3-peinafluoropropyl methacrylate, 2,2,3,3,4,4,5,5,6,6,7,7-dodecafluoroheptyl acrylate, 3,3,4,4,5,5,6,6,7,7,8,8,8-tridecafluorooctyl acrylate, 3,3,4,4,5,5,6,6,7,7,8,8,8-tridecafluorooctyl methacrylate, 2-[(1',1',1'-trifluoro-2-(trifluoromethyl)-2'-hydroxy) propyl]-3-norbornyl methacrylate, 1,1,1-trifluoro-2-(trifluoromethyl)-2-hydroxy-4-methyl-5-pentyl methacrylate, 3,3,4,4,5,5,6,6,7,7,8,8,9,9,10,10,10-heptaderafluorodecyl acrylate, 3,3,4,4,5,5,6,6,7,7,8,8,9,9,10,10,10-heptadecafluorodecyl methacrylate, 3,3,4,4,5,5,6,6,7,7,8,8,9,9,10,10,11,11,12,12,12-henicosafluorododecyl acrylate, 3,3,4,4,5,5,6,6,7,7,8,8,9,9,10,10,11,11,12,12,12-henicosafluorododecyl methacrylate, and 3,3,4,4,5,5,6,6,7,7,8,8,9,9,10,10,11,11,12,12,12-benicosa-11-(trifluoromethyl) dodecyl methacrylate. These may be used alone or in combination.

The marketed fluorine (meth)acrylic compound such as OPTOOL DAC-HP from Daikin Industries, Ltd MEGAFACE RS-75 from DIC Corp and Viscoat V-3F from OSAKA ORGANIC CHEMICAL INDUSTRY LTD. can be used.

The content of the fluorine (meth)acrylic compound in the first curing composition is not particularly limited, and can be selected according to purposes. The content there of is preferably from 0.1% to 50% by mass.

<<Othet Components>>

The other components are not particularly limited, and can be selected according to purposes. For examples, polymerization initiators, polymerization inhibitors, diluents, etc. can be used.

—Polymerization Initiator—

The polymerization initiators are not particularly limited if they initiate polymerization with light or heat, and can be selected according to purposes. Photoradical and photocationic polymerization initiators generating active species such as radical and cations with optical energy are preferably used, and particularly the photoradical polymerization initiators are more preferably used.

Specific examples of the photoradical polymerization initiators include aromatic ketones, acyl phosphine oxide compounds aromatic onium salt compounds, organic peroxides, thin compounds such as thioxanthone compounds and thiophenyl-group containing compounds), hexaatyl imidazole compounds, keto oxime ester compounds, borate compounds, azinium compounds, metallocene compounds, active ester compounds, compounds having carbon halogen bonds, alkylamine compounds, etc.

Specific examples of the photoradical polymerization initiators include, but are not limited to, acetophenone, acetophenone benzyl ketal, 1-hydroxy cyclohexyl phenyl ketone, 2,2-dimethoxy-2-phenyl acetophenone, xanthone, fluorenone, benzaldebyde, fluorene, anthraquinone, triphenyl amine, carbazole, 3-methyl acetophenone, 4-chlorobenzophenone, 4,4'-dimethoxy benzophenone, 4,4'-diaminobenzophenone, Michler ketone, benzoin propyl ether, benzoin ethyl ether, benzyl dimethyl ketal, 1-(4-isopropylphenyl)-2-hydroxy-2-methyl propan-1-one, 2hydroxy-2methyl-1phenyl propan-1-one, thioxanthone, diethyl thioxanthone, 2-isopropyl thioxanthone, 2-chlorothioxanthone, 2-methyl-1-[4-(methylthio)phenyl]-2-morpholino propan-1-one, bis(2,4,6-trimethyl benzoyl)-phenyl phosphine oxides, 2,4,6,-trimethyl benzoyl-diphenyl-phosphine oxides, 2,4-diethylthio xanthone, bis-(2,6-dimethoxy benzoyl)-2,4,4-trimethyl pentyl phosphine oxides. These may be used alone or in combination.

The marketed photoradical polymerization initiators such as Irgacure 651, Irgacure 184, DAROCUR 1173, Irgacure 2959, Irgacure 127, Irgacure 907, Irgacure 369, Irgacure 379, DAROCUR IPO, Irgacure 819, Irgacure 784, Irgacure, OXE 01, lrgacure OXE 02 and Irgacure 754 from in Ciba Speciality Chemicals, Inc.; Speedcure TPO from Lambson, Ltd.; KAYACURE DETX-S from Nippon Kayaku Co., Ltd.; Lucirin TPO, LR8893 and LR8970 from BASF AG; and EBECRYL P36 from UCB.

The content of the polymerization initiator is not particularly limited, and can be selected according to purposes. The content there oils preferably from 1% to 20% by mass relative to 100% by mass of the first curing composition.

—Polymerization Inhibitor—

Specific examples of the photoradical polymerization inhibitors include, but are not limited to, phenolic compounds such as p-methoxyphenol, cresol, 1-butyl catechol, the-t-butyl para-cresol, hydroquinone monomethyl ether, α-naphthol, 3,5-the-t-butyl-4-hydroxytoluene, 2,2-methylene bis(4-methyl-6-t-butyl phenol), 2,2'-methylene bis(4-ethyl-6-butyl phenol), and 4,4'-thiobis (3-methyl-6-t-butyl phenol); quinone compounds such as p-benzoquinone, anthraquinone, naphthoquinone, phenanthraquinone, p-xyloquinone, p-toluquinone, 2,6-dichloroquinone, 2,5-diphenyl-p-benzoquinone, 2,5,-diacetoxy-p-benzoquinone, 2,5-dicaproxy-p-benzoquinone, 2,5,-diacyloxy-p benzoquinone, hydroquinone, 2,5-di-butyl hydroquinone, thing-t-butyl hydroquinone, monomethyl hydroquinone, and 2,5-the-t-amyl hydroquinone; amine compounds such as phenyl-β-naphthylamine, p-benzyl aminophenol, the-β-naphthyl paraphenylene diamine, dibenzyl hydroxylamine, phenyl hydroxylamine, and diethyl hydroxylamine nitro compounds such as dinitrobenzene, trinitrotoluene, and picric acid; oxime compounds such as quinone dioxime, and cyclohexanone oxime; sulfur compounds such as phenothiazine. These may be used alone or in combination.

—Diluent—

Specific examples of the diluents include, but are not limited to, hydrocarbon solvents such as toluene and xylene; ester solvents such as ethyl acetate, n-butyl acetate, methyl cellosolve acetate, and propylene glycol monomethyl ether acetate; ketone solvents such as methyl ethyl ketone, methyl isobutyl ketone, diisobutyl ketone, cyclohexanone, and cyclopentanone; ether solvents such as ethylene glycol monomethyl ether, ethylene glycol monoethyl ether, and propylene glycol monomethyl ether; and alcohol solvents such as ethanol, propanol, 1-butanol, isopropyl alcohol, and isobutyl alcohol. These may be used alone or in combination.

Methods of including (impregnating) the cured material formed of the first curing composition in the contact portion of the elastic member are not particularly limited, and can be selected according to purposes. For example, the first curing composition may be impregnated in the contact portion of the elastic member by brush coating or dip coating and cured.

Methods of curing the first curing composition impregnated in the contact portion of the cleaning blade are not particularly limited, and can be selected according to purposes. For example, UV irradiation or heating can be used. Particularly, UV irradiation is preferably used.

Apparatuses irradiating UV are not particularly limited, and can be selected according to purposes. For example, an apparatus including an UV light source irradiating UV to an object to be cured while transferring the object with a transferer such as conveyors can be used.

The UV light source is not particularly limited if applicable with polymerization initiators used, and can be selected according to purposes. For examples, lamps and UV light emission semiconductor elements can be used.

Specific examples of the lamps include metal halide lamps, xenon lamps, carbon arc lamps, chemical lamps, low-pressure mercury lamps, high-pressure mercury lamps, etc. Specific examples of the marketed lamps include H bulb, D bulb and V bulb from Heraeus.

Specific examples of the UV light emission semiconductor elements include UV emitting diode, UV emitting semiconductor laser, etc.

The UV light is not particularly limited if applicable with polymerization initiators included in the curing composition, and can be selected according to purposes. For example, UV ray, flu UV ray, g-ray, h-ray, i-ray, KrF exima laser beam, ArF exima laser beam, electron beam. X-ray, molecular beam or ion beam having a wavelength of from 200 nm to 400 nm can be used.

Conditions of irradiating the UV are not particularly limited, and can be selected according to purposes. An integral of light is preferably not less than 500 [mJ/cm$^2$]. The UV is preferably irradiated under an inactive gas such as Ar, $N_2$ and $CO_2$ to suppress a curing rate from lowering due to oxygen.

As mentioned above, the contact portion contacting the member to be cleaned of the elastic member of the cleaning blade 62 can include the cured material formed of the first curing composition in a thickness direction from the surface of the contact portion.

A mixed layer including the urethane rubber of the elastic member and the cured material formed of the first curing composition is formed at the contact portion of the elastic member including the cured material formed of the first curing composition. A resin network chain is formed in the rubber and the rubber is thought to artificially increase in crosslink density to improve abrasion resistance. As a result, the contact portion of the elastic member has higher hardness and less tackiness to suppress the contact portion from turning over or deforming. Further, even when the contact portion exposes inside due to abrasion as time passes, the impregnation of the inside can suppress the contact portion from turning over or deforming as well.

<Surface Layer>

The contact portion may include a surface layer formed of the second curing composition on the surface.

<<Second Curing Composition>>

The second curing composition is preferably an UV curing composition.

The UV curing composition preferably includes a (meth) acrylate compound, and other components when necessary.

The (meth)acrylate compound is not particularly limited, and can be selected according to purposes. A (meth)actylate compound including a pentaerythritol structure in its molecule preferably used.

—(Meth)acrylate Compound including a Pentaerythritol Structure in its Molecule—

The (meth)acrylate compound including a pentaerythritol structure in its molecule preferably has to functional group equivalent molecular weight not greater than 110 and 3 to 6 functional group. Specific examples thereof include pentaerythritol tetra(meth)acrylate, pentaerythritol tri(meth) acrylate, pentaerythritol tetra(meth)acrylate, pentaerythritol ethoxytetra(meth)actylate, dipentaerythritol hexa(meth) acrylate, etc. Among these, pentaerythritol triacrylate, pentaerythritol tetraacrylate, and dipentaerythritol hexaacrylate are preferably used.

Figure 7A:
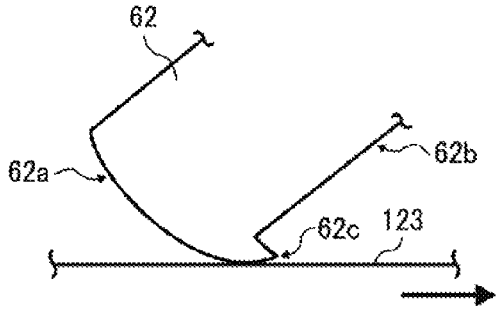
FIG. 7A is a schematic view illustrating the turned over edge ridgeline of a conventional cleaning blade.
Figure 7B:
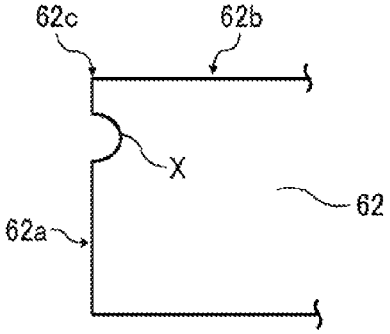
FIG. 7B is a schematic view for explaining a local abrasion of the edge face of the conventional cleaning blade.
Figure 7C:
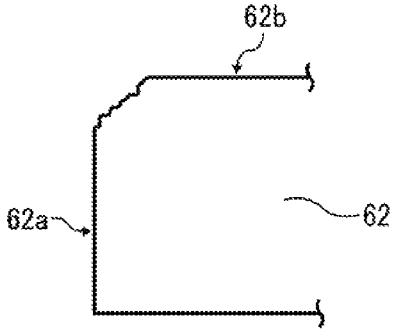
FIG. 7C is a schematic view illustrating the chipped edge ridgeline of the conventional cleaning blade.

The (meth)acrylate compound including a pentaerythritol structure in its molecule and having a functional group equivalent molecular weight not greater than 110 or a pentaerythritol triacrylate skeleton hardens the surface layer 623 and prevents the edge ridgeline 62*c* of the cleaning blade 62 from turning over. Therefore, the edge surface is not abraded as FIG. 7B shows and cleanability is maintained for long periods.

The content of the (meth)acrylate compound including a pentaerythritol structure in its molecule is not particularly limited, and can be selected according to purposes. The content there of is preferably from 20% to 90% by mass, and more preferably from 50% to 80% by mass relative to 100% by mass of the second curing composition.

The second curing composition may include a finethlacrylic compound having a molecular weight of from 100 to 1,500, a fluorine (methiactylic compound or as (meth) acrylic compound having an alicyclic structure in its molecule besides the (meth)acrylate compound including a pentaerythritol structure in its molecule.

Specific examples of the (meth)acrylic compound having a molecular weight of from 100 to 1,500, the fluorine (meth)acrylic compound and the (meth)acrylic compound having an alicyclic structure in its molecule include those included in the first curing composition.

Specific examples of the other components include those included in the first curing composition.

Methods of forming a surface layer formed of a cured material of the second curing composition on the contact portion of the elastic member are not particularly limited, and can be selected according to purposes. For example, the second curing composition may applied to the contact portion by spray coating to form a surface layer thereon and cured.

The surface layer preferably has a length not less than 500 μm from the edge ridgeline.

Methods of curing the second curing composition in the surface layer formed on the contact portion of the cleaning blade are not particularly limited, and can be selected according to purposes. For example, UV irradiation or heating can be used. Particularly. UV irradiation is preferably used.

Apparatuses irradiating UV are not particularly limited, and can be selected according to purposes. For example, an apparatus including an UV light source irradiating UV to an object to be cured while transferring the object with a transferer such as conveyors can be used.

The UV light source is not particularly limited if applicable with polymerization initiators used, and can be selected according to purposes. For examples, lamps and UV light emission semiconductor elements can be used.

Specific examples of the lamps include metal halide lamps, xenon lamps, carbon arc lamps, chemical lamps, low-pressure mercury lamps, high-pressure mercury lamps, etc. Specific examples of the marketed lamps include H bulb, D bulb and V bulb from Heraeus.

Specific examples of the UV light emission semiconductor elements include UV emitting diode. UV emitting semiconductor laser, etc.

The UV light is not particularly limited if applicable with polymerization initiators included in the curing composition, and can be selected according to purposes. For example, UV ray, far UV ray, g-ray, h-ray, i-ray, KrF exima laser beam, ArF exima laser beam, electron beam. X-ray, molecular beam or ion beam having a wavelength of from 200 nm to 400 nm can be used.

Conditions of irradiating the UV are not particularly limited, and can be selected according to purposes. An integral of light is preferably not less than 500 [m/J/cm$^2$]. The UV is preferably irradiated under an inactive was such as Ar, $N_2$ and $CO_2$ to suppress a curing rate from lowering due to oxygen.

The cleaning blade preferably has an elastic power of from 60% to 90% after modified. The elastic power is determined as follows from an integral stress when measuring Martens hardness. The Martens hardness is measured by pressing Vickers indenter at a specific force for 30 sec, holding for 5 sec, and drawing the indenter at a specific force for 30 sec with a microscopic durometer.

Figure 8:
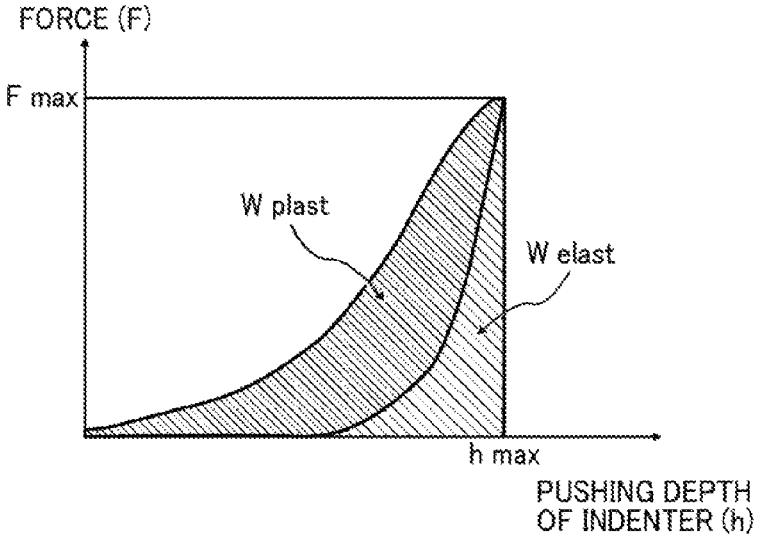
FIG. 8 is a diagram for explaining an elastic power.

The elastic power is defined by the following formula:

$$Welast/Wplast \times 100[\%]$$

wherein Wplast represents an integral stress when pressing the Vickers indenter; and Welast represents an integral stress when removing test load (FIG. 8). The higher the elastic power, the less the plastic deformation, i.e., the higher the rubber likeliness. When the elastic power is too low, the rubber is close to glass, and the movement of the contact portion is too restricted and the abrasion resistance deteriorates. Typically, the (meth)acrylic resin has a high elastic power in the above range of Martens hardness and is like a rubber. The (meth)acrylic resin may have too high elastic power to keep the position of a cleaning blade.

The cleaning blade 62 of the present invention can suppress the edge ridgeline 62*c* of the elastic member contacting the surface of the member to be cleaned from turning over, the edge ridgeline 62*c* of the elastic member is abraded less, and good cleanability can be maintained for long periods. Therefore, the cleaning blade can widely be used in various fields, and is preferably used in the following image forming apparatus and process cartridge in particular.

(Image Forming Apparatus and Image Forming Method)

The image forming apparatus of the present invention includes an image bearer, a charger to charge the surface of the image bearer, an irradiator to irradiate the charged image bearer to form an electrostatic latent image, an image developer to develop the electrostatic latent image with a toner to form a visible image, a transferer to transfer the visible image onto a recording medium, a fixer to fix the image transferred onto the recording medium, and a cleaner to remove the toner remaining on the image bearer. The cleaning blade of the present invention is used as the cleaner. The image bearer may include a lubricant applicator as a cleaning auxiliary means.

Figure 3:
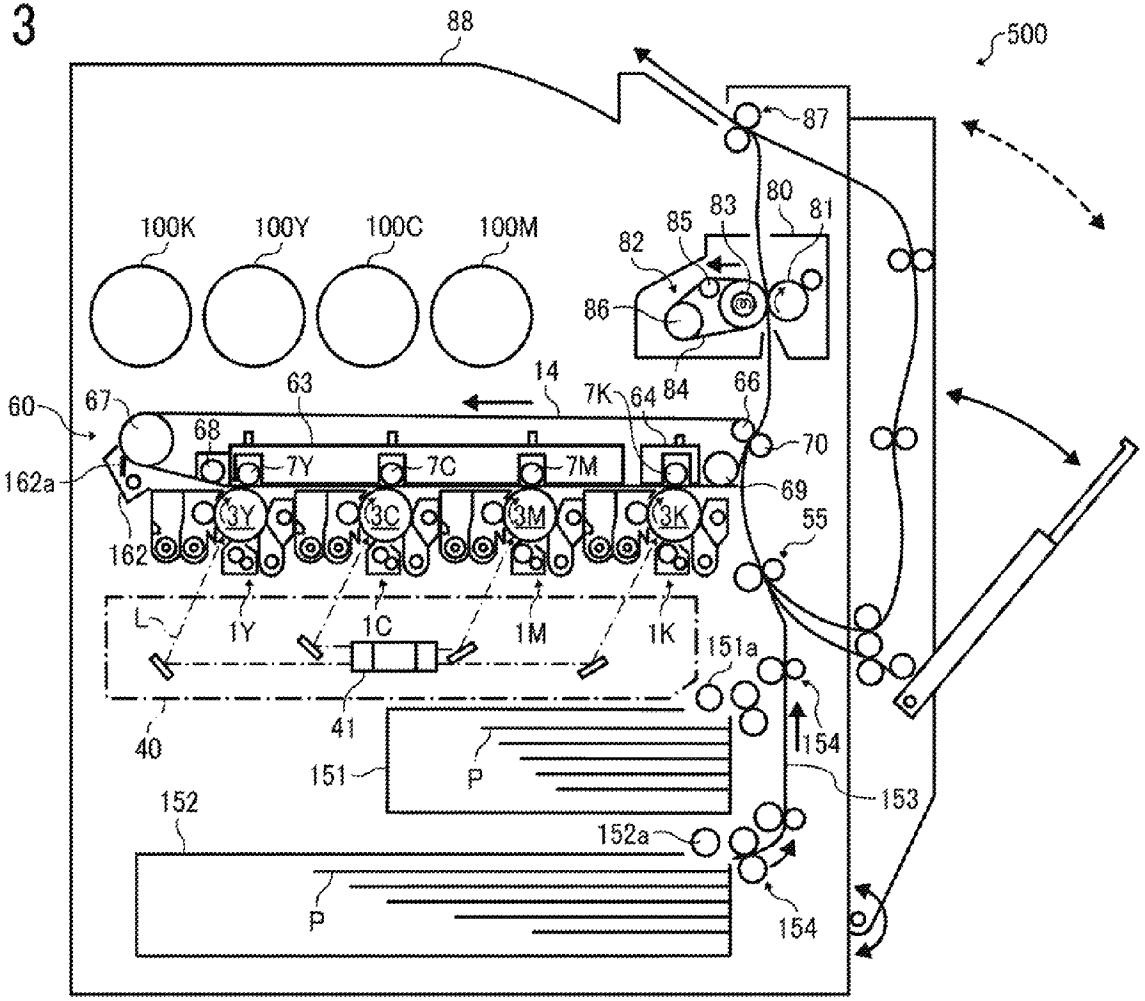
FIG. 3 is a schematic view illustrating an embodiment of the image forming apparatus of the present invention.

As the image forming apparatus of the present invention, an embodiment of electrophotographic printer (hereinafter referred to as printer 500) is explained. First, a basic constitution of the printer 500 of the present embodiment is explained. FIG. 3 is as schematic view illustrating the printer 500. The printer 500 includes four image forming units, i.e., yellow (Y), cyan (C), magenta (M) and black (K) image forming units 1Y, 1C, 1M and 1K. The four image forming units 1Y, 1C, 1M and 1K have the same configuration except that the color of toner used for developing an electrostatic latent image on a photoreceptor is different.

The printer 500 further includes a transfer unit 60, which includes an intermediate transfer belt 14 and which is located above the four image forming units 1. As mentioned later in detail, Y, C, M and K toner images formed on respective photoreceptors 3Y, 3C, 3M and 3K serving as photoreceptors are transferred onto the surface of the intermediate transfer belt 14 so as to be overlaid, resulting in formation of a combined color toner image on the intermediate transfer belt 14.

In addition, an optical writing unit 40 serving as as latent image former is located below the four image forming units 1. The optical writing unit 40 emits light beams L (such as laser beams) based on Y, C, M and K image information to irradiate the photoreceptors 3Y, 3C, 3M and 3K with the laser beams L, thereby forming electrostatic latent images, which respectively correspond to the Y, C, M and K images to be formed, on the photoreceptors. The optical writing unit 40 includes a polygon mirror 41, which is rotated by a motor and which reflects the light beams U emitted by a light source of the optical writing unit while deflecting the laser beams to irradiate the photoreceptors 3Y, 3C, 3M and 3K with the laser beams L via optical lenses and mirrors. The optical writing unit 40 is not limited thereto, and an optical writing unit using a LED array or the like can also be used therefor.

Below the optical writing unit 40, as first sheet cassette 151, and a second sheet cassette 152 are arranged so that the first sheet cassette is located above the second sheet cassette. Each of the sheet cassettes 151 and 152 contains a stack of paper sheets P serving as a recording material. Uppermost sheets of the paper sheets P in the first and second sheet cassettes 151 and 152 are contacted with a first feed roller 151*a* and a second feed roller 152*a*, respectively. When the first feed roller 151*a* is rotated (counterclockwise in FIG. 4) by a driver (not shown), the uppermost sheet P in the first sheet cassette 151 is fed by the first feed roller 151*a* toward a sheet passage 153 located on the right side of the printer 500 while extending vertically. Similarly, when the second feed roller 152*a* is rotated (counterclockwise in FIG. 4) by a driver (not shown), the uppermost sheet P in the second sheet cassette 152 is fed by the second feed roller 152*a* toward the sheet passage 153.

Plural pairs of feed rollers 154 are arranged in the sheet passage 153. The paper sheet P fed into the sheet passage 153 is fed from the lower side of the sheet passage 153 to the upper side thereof while being pinched by the pairs of feed rollers 154.

A pair of registration rollers 55 is arranged on the downstream side of the sheet passage 153 relative to the sheet feeding direction. When the pair of registration rollers 55 pinches the tip of the paper sheet P thus fed by the pairs of feed rollers 154, the pair of registration rollers 55 is stopped once, and is then rotated again to timely feed the paper sheet to a secondary transfer nip mentioned below so that a combined color toner image on the intermediate transfer belt 14 is transferred onto the predetermined position of the paper sheet P.

Figure 4:
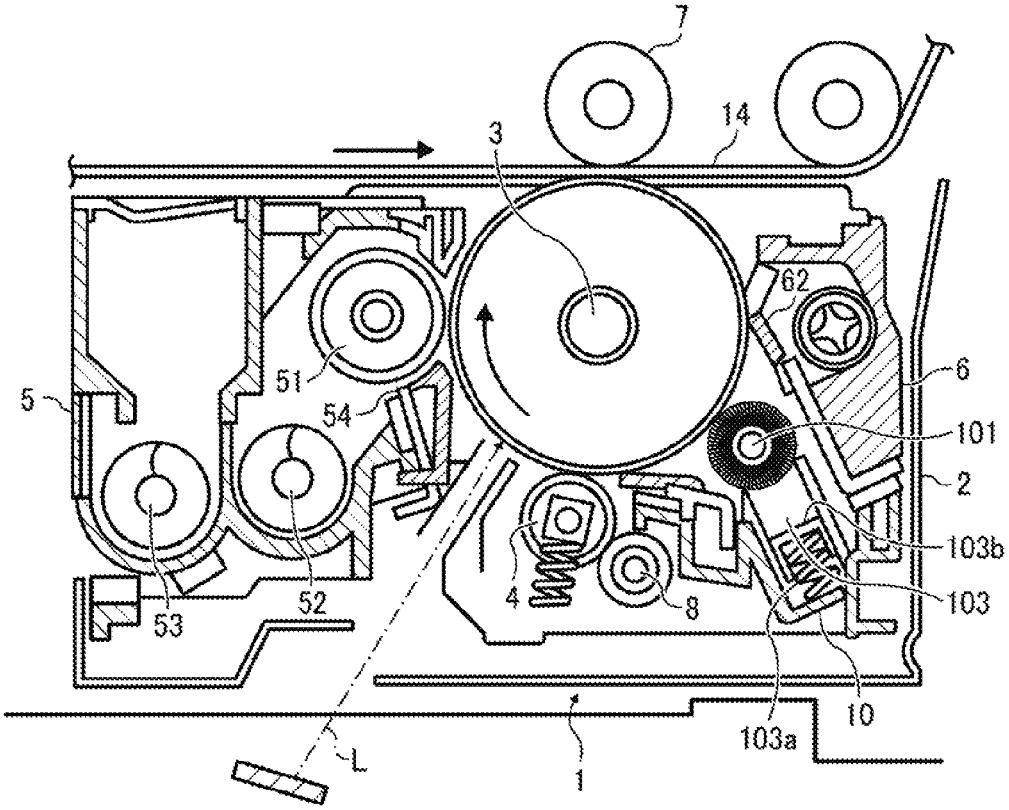
FIG. 4 is a schematic view illustrating an embodiment of the image forming unit of the image forming apparatus.

FIG. 4 illustrates one of the four image forming units 1.

As illustrated in FIG. 4, the image forming unit 1 includes a drum-shaped photoreceptor 3 serving as a photoreceptor. The shape of the photoreceptor 3 is not limited thereto, and sheet-shaped photoreceptors, endless belt-shaped photoreceptors and the like can also be used.

Around the photoreceptor 3, a charging roller 4, an image developer 5, a primary transfer roller 7, a cleaner 6, a lubricant applicator 10, a discharging lamp (not shown), etc., are arranged. The charging roller 4 serves as a charger for charging a surface of the photoreceptor 3. The image developer 5 serves as an image developer for developing an electrostatic latent image formed on the photoreceptor 3 with a developer to form a toner image thereon. The primary transfer roller 7 serves as a primary transferer for transferring the toner image on the photoreceptor 3 to the intermediate transfer belt 13. The cleaner 6 serves as a cleaner for removing residual toner from the surface of the photoreceptor 3 after transferring the toner image. The lubricant applicator 10 serves as a lubricant applicator for applying a lubricant to the surface of the photoreceptor 3 after cleaning the surface. The discharging lamp (not shown) serves as a discharger for decaying residual charges remaining on the surface of the photoreceptor 3 after cleaning the surface.

The charging roller 4 is arranged in the vicinity of the photoreceptor 3 with a predetermined gap therebetween, and evenly charges the photoreceptor 3 so that the photoreceptor 3 has a predetermined potential with a predetermined polarity. The thus evenly charged surface of the photoreceptor 3 is irradiated with the light beam L emitted by the optical writing unit 40 based on image information, thereby forming an electrostatic latent image on the surface of the photoreceptor 3.

The image developer 5 has a developing roller 51 serving as a developer bearing member. A development bias is applied to the developing roller 51 by a power source (not shown). A supplying screw 52 and an agitating screw 53 are provided in a casing of the image developer 5 to feed the developer in opposite directions in the casing so that the developer is charged so as to have a charge with a predetermined polarity. In addition, a doctor 54 is provided in the image developer to form a developer layer having a predetermined thickness on the surface of the developing roller 51. The layer of the developer, which has been charged so as to have a charge with the predetermined polarity, is adhered to an electrostatic latent image on the photoreceptor 3 at a development region, in which the developing roller 51 is opposed to the photoreceptor 3, resulting in formation of a toner image on the surface of the photoreceptor 3.

Figure 5A:
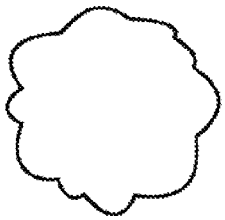
FIG. 5A is an explanatory drawing for explaining a method of measuring a circularity of a toner.
Figure 5B:
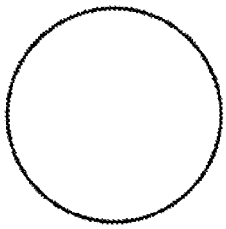
FIG. 5B is an explanatory drawing for explaining a method of measuring a circularity of a toner.

The cleaner 6 includes a fur brush 101, the cleaning blade 62, etc. The cleaning blade 62 is contacted with the surface of the photoreceptor 3 in such a manner as to counter the rotated photoreceptor 3. Details of the cleaning blade 62 will be mentioned later. The lubricant applicator 10 includes a solid lubricant 103, and as pressing spring 103*a* to press the solid lubricant 103 toward the fur brush 101 serving as a lubricant applicator to apply the lubricant to the surface of the photoreceptor 3. The solid lubricant 103 is supported by a bracket 103*b* while being pressed toward the fur brush 101 by the pressing spring 103*a*. The solid lubricant 103 is scraped by the fur brush 101, which is driven by the photoreceptor 3 so as to rotate (counterclockwise in FIG. 5), thereby applying the lubricant 103 to the surface of the photoreceptor 3. By thus applying the lubricant, the friction coefficient of the surface of the photoreceptor 3 is preferably controlled so as to be not higher than 0.2.

Although the non-contact short-range charging roller 4 is used as the charger of the image forming unit 1, the charger is not limited thereto, and contact chargers (such as contact charging rollers), corotrons, scorotrons, solid state chargers, and the like can also be used for the charger. Among these chargers, contact chargers, and non-contact short-range chargers are preferable because of having advantages such that the charging efficiency is high, the amount of ozone generated in a charging, operation is small, and the charger can be miniaturized.

Specific examples of light sources for use in the optical writing unit 40 and the discharging, lamp include any known light emitters such as fluorescent lamps, tungsten lamps, halogen lamps, mercury lamps, sodium lamps, light emitting diodes (LEDs), laser diodes (LDs), electroluminescent lamps (ELs), and the like.

In order to irradiate the photoreceptor 3 with light having a wavelength in a desired range, sharp cut filters, bandpass filters, infrared cut filers, dichroic filters, interference filters, color temperature converting filters, and the like can be used.

Among these light sources, LEDs and LDs are preferably used because of having advantages such that the irradiation energy is high, and light having a relatively long wavelength in the range of 600 to Man can be emitted.

The transfer unit 60 serving as a transferer includes not only the intermediate transfer belt 14, but also a belt, cleaning unit 162, a first bracket 63, and a second bracket 64. In addition, the transfer units 60 further includes four primary transfer rollers 7Y, 7C, 7M and 7K, a secondary transfer backup roller 66, a driving roller 67, a supplementary roller 68, and a tension roller 69. The intermediate transfer belt 14 is rotated counterclockwise in an endless manner by the driving roller 67 while being tightly stretched by the four rollers. The four primary transfer rollers 7Y, 7C, 7M and 7K press the thus rotated intermediate transfer belt 14 toward the photoreceptors 3Y, 3C, 3M and 3K, respectively, to form four primary transfer nips. In addition, a transfer bias having a polarity opposite that of the charge of the toner is applied to the backside (i.e., inner surface) of the intermediate transfer belt (for example, a positive bias is applied when a negative toner is used). Since the intermediate transfer belt 14 is rotated endlessly, yellow, cyan, magenta and black toner images, which are formed on the photoreceptors 3Y, 3C, 3M and 3K, respectively, are sequentially transferred onto the intermediate transfer belt 14 so as to be overlaid, resulting in formation of a combined 4-color toner image (hereinafter referred to as a 4-color toner image) on the intermediate transfer belt 14.

The secondary transfer backup roller 66 and a secondary transfer roller 70 sandwich the intermediate transfer belt 14 to form a secondary transfer nip. As mentioned above, the pair of registration rollers 55 pinches the transfer paper sheet P once, and then timely feeds the paper sheet P toward the secondary transfer nip so that the combined color toner image on the intermediate transfer belt 14 is transferred onto a predetermined position of the paper sheet P. Specifically, the entire combined color toner image is transferred due to a secondary transfer electric field formed by the secondary transfer roller 70, to which a secondary transfer bias is applied, and the secondary transfer backup roller 66, and a nip pressure applied between the secondary transfer roller 70 and the transfer backup roller 66, resulting in formation of a full color toner image on the paper sheet P having white color.

After passing the secondary transfer nip, the intermediate transfer belt 14 bears residual toners (i.e., not toners) on the surface thereof. The belt cleaning unit 162 removes the residual toners from the surface of the intermediate transfer belt 14. Specifically, a belt cleaning blade 162*a* of the belt cleaning unit 162 is contacted with the surface of the intermediate transfer belt 14 to remove the residual toners therefrom.

The first bracket 63 of the transfer unit 60 is rotated at a predetermined rotation angle on a rotation axis of the supplementary roller 68 by being driven by an on/off operation of a solenoid (not shown). When a monochromatic image is formed, the printer 500 slightly rotates the first bracket 63 counterclockwise by driving the solenoid. When the first bracket 63 is thus rotated, the primary transfer rollers 7Y, 7C and 7M are moved counterclockwise around the rotation axis of the supplementary roller 68, thereby separating the intermediate transfer belt 14 from the photoreceptors 3Y, 3C and 3M. Thus, only the black image forming unit 1K is operated (without driving the color image forming units 1Y, 1C and 1M) to form a monochromatic image. By using this method, the life of the parts of the color image forming units 1Y, 1C and 1M can be prolonged.

A fixing unit 80 is provided above the secondary transfer nip. The fixing unit 80 includes a pressure/heat roller 81 having a heat source (such as a halogen lamp) therein, and a fixing belt unit 82. The fixing belt unit 82 includes an endless fixing belt 84 serving as a fixing member, a heat roller 83 having a heat source (such as a halogen lamp) therein, a tension roller 85, a driving roller 86, a temperature sensor (not shown), and the like. The endless fixing belt 84 is counterclockwise rotated endlessly by the driving roller 86 while being tightly stretched by the heat roller 83, the tension roller 85 and the driving roller 86. When the fixing belt 84 is rotated, the fixing belt is heated by the heat roller 83 from the backside thereof. The pressure/heat roller 81 is contacted with the front surface of the fixing belt 84 while pressing the fixing belt 84 to the heat roller 83, resulting in formation of a fixing nip between the pressure/heat roller 81 and the fixing belt 84.

A temperature sensor is provided so as to be opposed to the front surface of the fixing belt 84 with a predetermined gap therebetween to detect the temperature of the fixing belt 84 at a location just before the fixing nip. The detection data are sent to a fixing device supply circuit. The fixing device supply circuit performs ON/OFF control on the heat source in the heat roller 83 and the heat source in the pressure/heat roller 81.

The transfer paper sheet P passing, the secondary transfer nip and separated from the intermediate transfer belt 14 is fed to the fixing unit 80. When the paper sheet P bearing the unfixed full color toner image thereon is fed from the lower side of the fixing unit 80 to the upper side thereof while being sandwiched by the fixing belt 14 and the pressure/heat roller 81, the paper sheet P is heated by the fixing belt 84 while being pressed by the pressure/heat roller 81, resulting in fixation of the full color toner image on the paper sheet P.

The paper sheet P thus subjected to a fixing treatment is discharged from the main body of the printer 500 by a pair of discharging rollers 87 so as to be stacked on a surface of a stacking portion 88.

Four toner cartridges 100Y, 100C, 100M and 100K respectively containing yellow, cyan, magenta and black color toners are provided above the transfer unit 60 to supply the yellow, cyan, magenta and black color toners to the corresponding image developers 5Y, 5C, 5M and 5K of the image forming units 1Y, 1C, 1M and 1K, if desired. These toner cartridges 100Y, 100C, 100M and 100K are detachable from the main body of the printer 500 independently of the image forming units 1Y, 1C, 1M and 1K.

Next, the image forming operation of the printer 500 is explained.

Upon receipt of a print execution signal from an operating portion (not shown) such as an operation panel, predetermined voltages or currents are applied to the charging roller 4 and the developing roller 51 at predetermined times. Similarly, predetermined voltages or currents are applied to the light sources of the optical writing unit 40 and the discharging lamp. In synchronization with these operations, the photoreceptors 3 are rotated in a direction indicated by an arrow by a driving motor.

When the photoreceptors 3 are rotated, the surfaces thereof are charged by the respective charging rollers 4 so as to have predetermined potentials. Next, light beams (such as laser beams) emitted by the optical writing unit 40 irradiate the charged surfaces of the photoreceptors 3 to be discharged, thereby forming electrostatic latent images on the surface of the photoreceptors 3.

The surfaces of the photoreceptors 3 bearing the electrostatic latent images are rubbed by magnetic, brushes of the respective developers formed on the respective developing, rollers 51. In this case, the (negatively-charged) toners on the developing rollers 51 are moved toward the electrostatic latent images by the development biases applied to the developing rollers 51, resulting in formation of color toner images OR the surface of the photoreceptors 3Y, 3C, 3M and 3K.

Thus, each of the electrostatic latent images formed on the photoreceptors 3 is subjected to a reverse development treatment using a negative toner. In this example, an N/P (negative/positive: a toner adheres to as place having lower potential) developing method using a non-contact charging roller is used, but the developing method is not limited thereto.

The color toner images formed on the surfaces of the photoreceptors 3Y, 3C, 3M and 3K are primarily transferred to the intermediate transfer belt 14 so as to be overlaid, thereby forming a combined color toner image on the intermediate transfer belt 14.

The 4-color toner image thus formed on the intermediate transfer belt 14 is transferred onto a predetermined portion of the paper sheet P, which is fed from the first or second cassette 151 or 152 and which is timely fed to the secondary transfer nip by the pair of registration rollers 55 after being pinched thereby. After the paper sheet P bearing the combined color toner image thereon is separated from the intermediate transfer belt 14, the paper sheet P is fed to the fixing unit 80. When the paper sheet P bearing the combined color toner image thereon passes the fixing unit 80, the combined toner image is fixed to the paper sheet P upon application of heat and pressure thereto. The paper sheet P bearing the fixed combined color toner image (i.e., a full color image) thereon is discharged from the main body of the printer 500, resulting in stacking on the surface of the stacking portion 88.

Toners remaining on the surface of the intermediate transfer belt 14 even after the combined color toner image thereon is transferred to the paper sheet P are removed therefrom by the belt cleaning unit 162.

Toners remaining on the surfaces of the photoreceptors 3 even after the color toner images thereon is transferred to the intermediate transfer belt 14 are removed therefrom by the cleaner 6. Further, the surfaces of the photoreceptors 3 are coated with a lubricant by the lubricant applicator 10, followed by a discharging treatment using a discharging lamp.

As illustrated in FIG. 4, the photoreceptor 3, the charging roller 4, the developing device 5, the cleaner 6, the lubricant applicator 10, and the like are contained in a case 2 of the image forming unit 1 of the printer 500. The image forming unit 10 is detachable attachable to the main body of the printer 500 as a single unit (i.e., process cartridge). However, the image forming unit 1 is not limited thereto, and may have a configuration such that each of the members and devices such as the photoreceptor 3, charging roller 4, developing device 5, cleaner 6, and lubricant applicator 10 is replaced with a new member or device.

Next, a toner preferably used in the printer 500 of the present invention is explained.

A toner used in the printer 500 preferably has a high circularity and a small particle diameter. Such a toner can be preferably prepared by polymerization methods such as suspension polymerization methods, emulsion polymerization methods, dispersion polymerization methods, and the like. The toner preferably has an average circularity not less than 0.97, and a volume-average particle diameter not greater than 5.5 μm to produce higher resolution images.

The circularity of the toner is measured by a flow-type particle image analyzer FPIA-2000 from SYSMEX CORPORATION. A specific measuring method includes adding 0.1 to 0.5 ml of a surfactant, preferably an alkylbenzenesulfonic acid, as a dispersant in 100 to 130 ml of water from which impure solid materials are previously removed; adding 0.1 to 0.5 g of the toner in the mixture; dispersing the mixture including the toner with an ultrasonic disperser for 1 to 3 min to prepare a dispersion liquid having a concentration of from 3,000 to 10000 pieces/μl; and measuring the toner shape and distribution with the above-mentioned measurer. Based on the measured result, an average of C2/C1 is determined as a circularity, when C1 is an outer circumferential length of the actual toner projected shape in FIG. 5A, and C2 is an outer circumferential length of a true circle having the same area as a projected area S of the actual toner projected shape in FIG. 5B.

The volume-average particle diameter can be measured by a Coulter Multisizer 2e from Beckman Coulter, Inc. as follows:

0.1 to 5 ml of a surfactant, preferably alkylbenzene sulfonate salt was included as a dispersant in 100 to 150 ml of an electrolyte including primary sodium chloride in an amount of 1% by weight;

2 to 20 mg of a sample were included in the electrolyte and dispersed by an ultrasonic disperser for about 1 to 3 min to prepare a sample dispersion liquid; and Placing 100 to 200 ml of the electrolyte in another beaker and adding the sample dispersion liquid to measure the volume-average particle diameter by the Coulter Multisizer 2e using an aperture of 100 μm, 50,000 toner particles and the following 13 channels:

2.00 to 2.52 μm; 2.52 to 3.17 μm; 3.17 to 4.00 μm; 4.00 to 5.04 μm; 5.04 to 6.35 μm; 6.35 to 8.00 μm; 8.00 to 10.08 μm; 10.08 to 12.70 μm; 12.70 to 16.00 μm; 16.00 to 20.20 μm; 20.20 to 25.40 μm; 25.40 to 32.00 μm; and 32.00 to 40.10 μm.

In the present invention, an interface producing a number distribution and a volume distribution from Nikkaki Bios Co., Ltd. and a personal computer are connected with the Coulter Multisizer 2e to measure the volume-average particle diameter.

The volume-average particle diameter is determined by the following formula:

$$\Sigma XfV/\Sigma fV$$

wherein X is a representative diameter of each channel, V is an equivalent volume of the representative diameter of each channel, and f is the number of particles of each channel.

The polymerization toner cannot be fully removed by the cleaning blade 62 as the pulverization toner cannot from the photoreceptor 3, resulting in poor cleaning. When the contact pressure of the cleaning blade 62 against the photoreceptor 3 is increased to improve cleanability of the cleaning blade 62, the cleaning blade 62 is abraded earlier. Further, when a friction between the cleaning blade 62 and the photoreceptor 3 increases, the cleaning blade 62 is drawn in a travel direction of the image bearer, and an edge contacting the photoreceptor 3 of the cleaning blade 62 is drawn in a travel direction of the photoreceptor 3 is turned over. When the edge of the cleaning blade 62 is turned over, various problems such as noises, vibrations and chipped edge ridgeline.

The cleaning blade of the present invention does not have defective cleaning, noises, vibrations and chipped edge ridgeline even when the polymerization loner is used.

The process cartridge of the present invention includes at least an image bearer and a cleaner to remove the toner remaining on the image bearer. The cleaning blade of the present invention is used as the cleaner. The image bearer may include a lubricant applicator as a cleaning auxiliary means.

EXAMPLES

Having generally described this invention, further understanding can be obtained by reference to certain specific examples which are provided herein for the purpose of illustration only and are not intended to be limiting, in the descriptions in the following examples, the numbers represent mass ratios in parts, unless otherwise specified.

<JIS-A Hardness of Substrate>

The JIS-A hardness of the undersurface of the substrate of the elastic member was measured by micro rubber durometer MD-1 from KOBUNSHI KEIKI CO., LTD. according to JIS K6253 [23° C.].

<Impact Resilience Coefficient>

The impact resilience coefficient of the substrate of the elastic member was measured at 23° C. by a resilience tester No. 221 from Toyo Seiki Seisaku-sho. Ltd. according to JIS K6255. Two sheets having a thickness about 2 mm of the sample to be measured were layered to have a thickness not less than 4 mm.

Substrate of the elastic member, impregnating materials (curing compositions) for impregnated portions, impregnating time, surface treatment materials for surface layer (curing compositions), average thickness of surface layer, surface roughness of surface layer were changed in the following Examples and Comparative Examples.

As the substrate of the elastic member, two urethane rubbers having hardnesses, impact resilience coefficients at 23° C. and Martens hardnesses in Table 1 were prepared,

TABLE 1

| No. | Base Rubber Constitution | Impact Resilience Coefficient at 23° C. [%] | Hardness of Undersurface of Substrate at 23° C./JIS-A° | HM [N/mm$^2$] |
|---|---|---|---|---|
| 1 | Single Layer | 45 | 75 | 0.9 |
| 2 | Single Layer | 18 | 71 | 0.6 |

PREPARATION EXAMPLE

—Preparation of Curing Composition—

Curing compositions 1 to 7 ere prepared according to the formulations shown in Table 2 by typical methods. The curing compositions 1 to 6 are UV curing compositions and the curing composition 7 is a heat curing composition,

TABLE 2

| Curing Composition | Ratio of Curing Material Resin | | Ratio of Polymerization Initiator to Resin | Solvent | Concentration of Solid Content of Resin |
|---|---|---|---|---|---|
| 1 | Resin 1: ODA | 55% | Polymerization Initiator: | Cyclohexanone | 70% |
| | Resin 2: A-DCP | 45% | Irgacure 184 1% | | |
| 2 | Resin 1: A-DCP | 85% | Polymerization Initiator: | Cyclohexanone | 70% |
| | Resin 2: EBECRYL 140 | 15% | Irgacure 184 15% | | |
| 3 | Resin 1: EBECRYL 140 | 95% | Polymerization Initiator: | Cyclohexanone | 50% |
| | Resin 2: OPTOOL DAC-HP | 5% | Irgacure 184 5% | | |
| 4 | Resin 1: PETIA | 75% | Polymerization Initiator: | MEK | Table 5 |
| | Resin 2: ODA | 24% | Irgacure 184 10% | | |
| | Resin 3: OPTOOL DAC-HP | 1% | | | |
| 5 | Resin 1: DPHA | 60% | Polymerization Initiator: | MEK | Table 5 |
| | Resin 2: PETIA | 40% | Irgacure 184 3% | | |
| 6 | Resin 1: A-DCP | 100% | Polymerization Initiator: | MEK | Table 5 |
| | | | Irgacure 184 5% | | |
| 7 | Resin 1: SQ100 | 100% | Polymerization Initiator: | MEK | 50% |
| | | | UAX-615 20% | | |

Details of Caring materials in the curing, compositions 1 to 7 are showing Tables 3 and 4.

TABLE 3

| Curing Material | | Molecular Structure |
|---|---|---|
| PETIA | Pentaerythritol triacrylate | 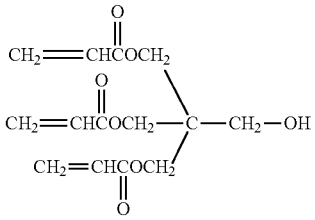 |
| ODA | Octyl/decyl acrylate | 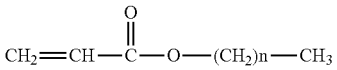 n = 7 or 9 |
| A-DCP | Tricyclodecane dimethanol diacrylate (alicyclic structure) | 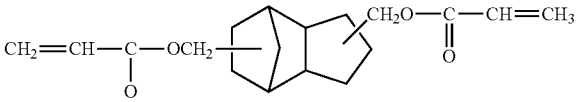 |
| DPHA | Dipentaerythritol hexaacrylate | 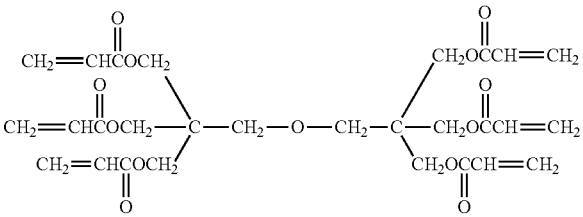 |
| OPTOOL DAC-HP | Fluorine acrylate (perfluoropolyether skeleton) | |
| EBECRYL140 | Ditrimethylol propane tetraacrylate | 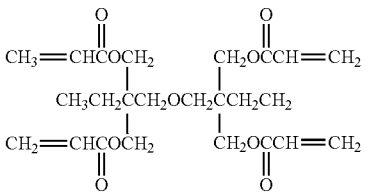 |

TABLE 3-continued

| Curing Material | | Molecular Structure |
|---|---|---|
| SQ100 | (Silicon-modified acrylic resin) | 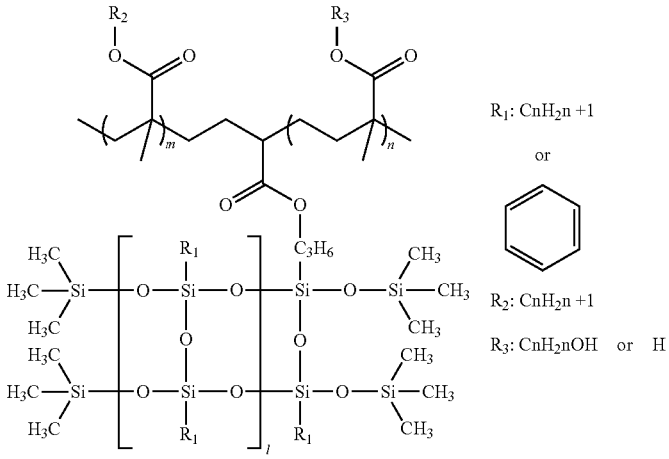 |

TABLE 4

| Material | Manufacturer | Number of Functional Groups | Molecular Weight |
|---|---|---|---|
| PETIA | DAICEL-ALLNEX LTD. | 3 | 298/352 |
| ODA | DAICEL-ALLNEX LTD. | 1 | 200 |
| A-DCP | Shin-Nakamura Chemical Co., Ltd. | 2 | 304 |
| DPHA | DAICEL-ALLNEX LTD. | 6 | 524 |
| OPTOOL DAC-HP | DAIKIN INDUSTRIES, Ltd. | — | — |
| EBECRYL140 | DAICEL-ALLNEX LTD. | 4 | 438 |
| SQ100 | TOKUSHIKI Co., Ltd. | — | — |
| Irgacure 184 | Ciba-Geigy Japan Limited | — | — |
| UAX-615 | TOKUSHIKI Co., Ltd. | — | — |

<Toner Preparation Example>

A toner was prepared by t polymerization method disclosed in Japanese published unexamined application No. JP-2014-92633-A. The properties of the toner are as follows.

Toner base particles: an average circularity of 0.98 and an average particle diameter of 4.9 μm.

External additives: 1.5 parts of silica having as small particle diameter H2000 from Clariant (Japan) 0.5 parts of titanium oxide having as small particle diameter MT-150AI from Tayca Corp., and 1.0 part of silica having as large particle diameter UFP-30H from DENKI KAGAKU KOGYO KABUSHIKI KAISHA Glass transition temperature: 50° C.

Example 1

<Preparation of Cleaning Blade 1>

After 3 mm width from the edge surface of as strip-shaped substrate 1 having a thickness of 1.8 mm was dipped in a curing composition 1 for 400 s, a residue of the curing composition 1 adhering to the surface of the substrate 1 was washed with cyclohexane and dried by air for 2 min.

Next, a solution including a solid content of the curing composition 4 at a concentration of 20% was coated by spraying on the contact portion (edge ridgeline) of the substrate 1 after impregnated to form a surface layer thereon. Specifically, all the impregnated edge surface of the substrate was double coated by spray coating at 6 mm/s. After 3 min touch drying, a surface layer having an average thickness of 1.8 μm was formed from 3 mm width from the edge ridgeline on the undersurface of the substrate. After 3 min touch drying, the surface layer was irradiated with UV by a high-pressure mercury lamp such that an UV cumulative radiation was 6,000 [gf/mm$^2$] under a nitrogen atmosphere. The edge ridgeline of the blade was set upward to the above high-pressure mercury lamp so as to efficiently be irradiated with UV.

Each of the elastic member having the contact portion on which a surface layer was formed was fixed on metal plate holder with an adhesive to be installed in a color multifunctional machine imagio MP C4500 from Ricoh Company, Ltd. Thus, a cleaning blade 1 having the contact portion a surface layer was formed on was prepared.

<UV Integral Measurement Method>

UV integral at 254 nm was measured by UV integral measurer UIT-250 from USHIO INC. The measurement was made such that a sensor of the UV integral measurer and the edge ridgeline of the cleaning blade were located at the same height.

Properties of the elastic members and cleaning blades were measured as follows.

The results are shown in Table 5.

<Average Thickness of Surface Layer>

Figure 9:
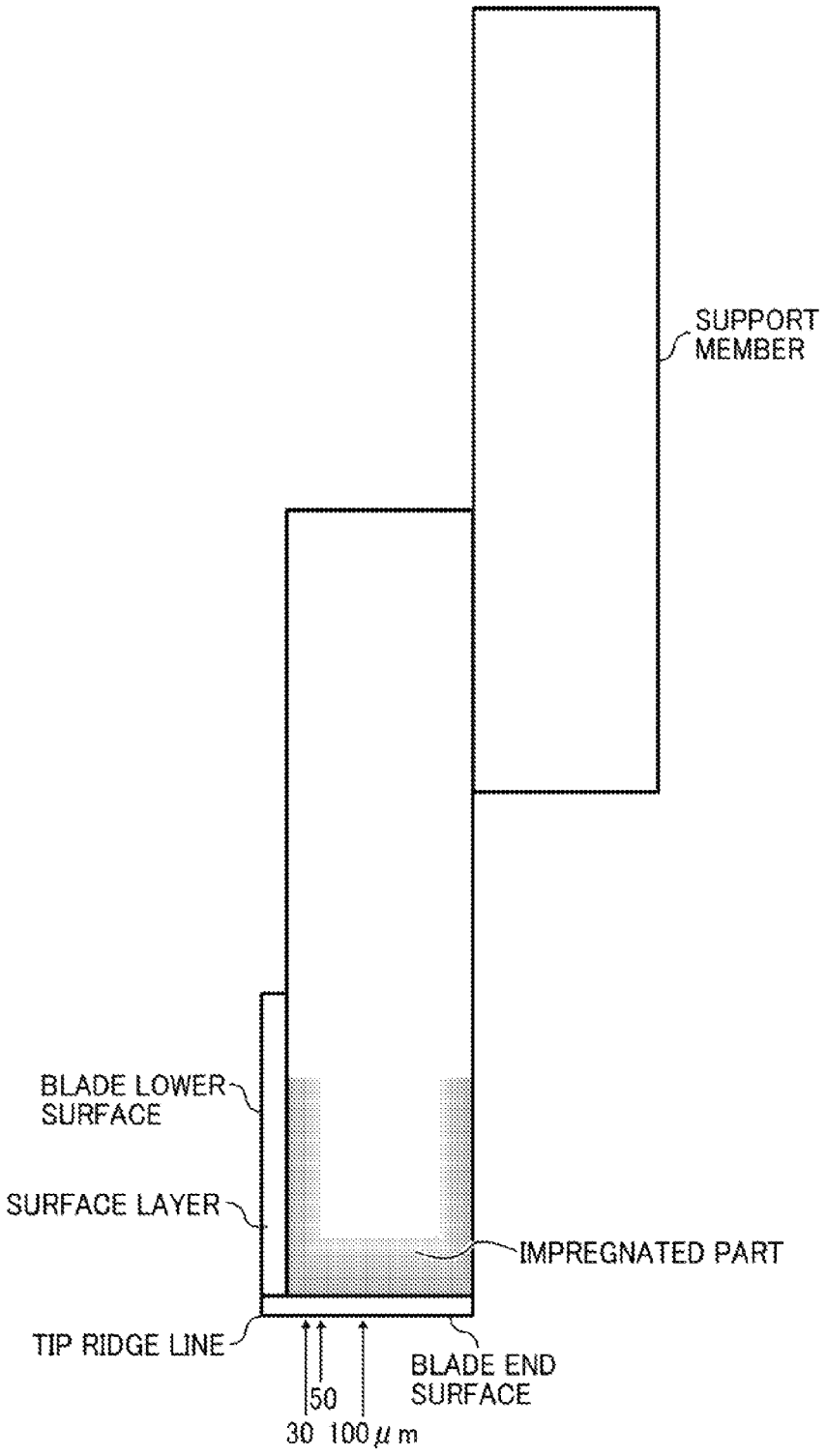
FIG. 9 is a cross-sectional view illustrating a measured point of an average thickness of a surface layer of the elastic member.

FIG. 9 is a cross-sectional view illustrating a measured point of an average thickness of a surface layer of the cleaning blade.

As shown in FIG. 9, the elastic member was cut at a surface perpendicular to its longitudinal direction and the cross section was observed with a digital microscope VHX-100 from Keyence Corp. The thicknesses of the surface layer at positions 30, 50 and 100 μm from the contact portion (edge ridgeline) of the blade undersurface in a thickness direction of the elastic member in the blade edge surface were measured. An average thereof was an average thickness of the surface layer.

The elastic member was vertically cut with a razor relative to its longitudinal direction to have a thickness of 3 mm in its longitudinal direction. A vertical slicer can cut the elastic member to form a clean cross section. The elastic member was cut except for the parts 0 to 2 cm from its both ends.

<Surface Roughness of Modified Portion>

The surface roughness Ra was measured with a laser microscope VK9500 from Keyence Corp. according to JIS B 0601-1994 Three (3) points within 1 mm from the edge ridgeline of the undersurface of the elastic member were measured and averaged.

<Tack Maximum Value>

Figure 10:
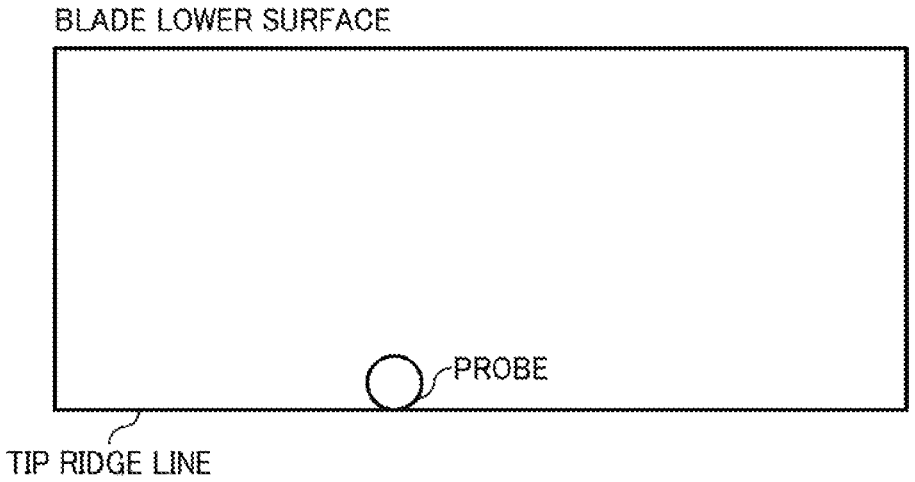
FIG. 10 is a cross-sectional view illustrating a measured point of a tack maximum value of the surface of a modified portion.

The tack maximum value was measured by a tacking tester TAC-II from Rhesca Corp. A SUS probe having a diameter of 5 mm or 8 mm was used m measurement at load of 200 g, a pressing time of 2 sec, a drawing speed of 600 mm/min and a temperature of 23° C. The blade undersurface of the elastic member was measured and the edge ridgeline is the end of the probe position as shown in FIG. 10.

In the present invention, the tack maximum value was measured three times and an average is a tack maximum value of the sample.

As for the tack maximum value of the surface of the modified portion of the cleaning blade, when the modified portion was smaller than the probe diameter, a sample including a modified portion having a diameter larger than the probe diameter was prepared to measure.

The inner surface at the depth of 5 μm of the modified portion of the blade undersurface was exposed with a Cryo-Microtome using a diamond knife Cryo Dry as Shown in FIG. 6B.

<Martens Hardness>

The Martens hardness (HM) at a position 20 μm from the edge ridgeline was measured by a microscopic hardness meter HM-2000 from Fischer Instruments is used, in which Vickers indenter is pushed into art object at 1.0 mN for 10 sec, held for 5 sec, and drawn at 1.0 mN for 10 sec. The blade undersurface was measured Image Forming Apparatus of Example 1

<Assembly of Image Forming Apparatus>

The cleaning blade 1 was installed in the color multifunctional machine iruagio MP C4500 from Ricoh Company, Ltd. (including a printing section having the same configuration as that of the image forming, apparatus 500 in FIG. 3) to assemble an image forming apparatus of Example 1.

The cleaning blade was installed so as to have a linear pressure of 20 g/cm and a cleaning angle of 79°. The apparatus has a lubricator applying a lubricant to the surface of the photoreceptor to maintain a static friction coefficient thereof not greater than 0.2 when not forming images. The static friction coefficient of the surface of the photoreceptor was measured by oiler belt method disclosed in column [0046] of Japanese published unexamined application No. JP-H09-166919-A.

<Image Forming Conditions>

One hundred thousand (100,000) A4 images having an image area of 5% at 3 prints/job were produced at 21° C. and 65% Rh. The following properties were evaluated after 10,000 and 100,000 images were produced as follows.

<Clean Ability>

Twenty (20) A4 images of three vertical zone pattern having a width of 43 mm were produced in the paper travel direction to visually observe whether abnormal images due to detective cleaning were produced. Good and Fair were acceptable and Poor was unacceptable.

[Evaluation Criterial]

Good: Scraped-off toner was observed neither on images nor photoconductor

Fair: Scraped-off toner was not observed on images, but observed on photoconductor Poor: Scraped-off toner was observed both on images and photoconductor <Abnormal Noise>

When the images for cleanability evaluation were produced, whether abnormal noises were made was aurally judged. Regardless of high or low frequency, noises from the blade were abnormal noises without distinction.

[Evaluation Criteria]

Good: No abnormal noise

Poor: Abnormal noises were made

<Color Registration Error>

Twenty (20) A4 images combining a double color rectangular solid image and a double color letter image were produced at 5 prints/job to observe visually and with a pocket microscope (25×). Good and Fair were acceptable and Poor was unacceptable.

[Evaluation Criteria]

Good: No color registration error was observed even with a pocket microscope

Fair: Color registration error was observed with a pocket microscope, but acceptable Poor: Color registration error was visually observed Examples 2 to 8 and Comparative Examples 1 to 4

The procedure for preparation of the cleaning blade 1 in Example 1 was repeated except for changing the substrate. UV curing composition for impregnating, impregnating time. UV curing composition for forming surface layer, and the thickness of the surface layer to prepare the cleaning blades 2 to 8 and 10 to 13 of Examples 2 to 8 and Comparative Examples 1 to 4.

Example 9

After 3 mm width from the edge surface of a strip-shaped substrate having a thickness of 1 mm was dipped in a curing composition 7 for 400 s, a residue of the curing composition 1 adhering to the surface of the substrate 1 was washed with cyclohexane and dried by air for 2 min.

Next, a solution including a solid content of the curing composition 7 at a concentration of 20% was coated by spraying on the contact portion (edge ridgeline) of the substrate 1 after impregnated to form a surface layer thereon. Specifically, all the impregnated edge surface of the substrate 1 was double coated by spray coating at 6 mm/s. After 3 min touch drying, a surface layer having an average thickness of 17 μm was formed from 3 mm width from the edge ridgeline on the undersurface of the substrate. Then, after preliminarily dried at 80° C. for 3 min in a thermostatic chamber, the surface layer was heated at 80° C. for 60 min in the thermostatic chamber to be cured.

The procedures for assembling the image forming apparatus and evaluation of the cleaning blade 1 in Example 1 were repeated to assemble and evaluate image forming apparatuses of Examples 2 to 9 and Comparative Examples 1 to 4. The results are shown in Table 6.

TABLE 5

| | | Urethane Rubber | Curing Material for Impregnation | Impregnating Time [s] | Curing Material for Surface Layer | Solid Content Concentration of Curing Material for Surface Layer [%] |
|---|---|---|---|---|---|---|
| Example 1 | Cleaning Blade 1 | 1 | 1 | 400 | 4 | 20 |
| Example 2 | Cleaning Blade 2 | 1 | 2 | 900 | 5 | 20 |
| Example 3 | Cleaning Blade 3 | 1 | 3 | 90 | 5 | 10 |
| Example 4 | Cleaning Blade 4 | 2 | 2 | 400 | 4 | 10 |
| Example 5 | Cleaning Blade 5 | 2 | 2 | 1000 | 6 | 30 |
| Example 6 | Cleaning Blade 6 | 2 | 1 | 400 | — | — |
| Example 7 | Cleaning Blade 7 | 2 | — | — | 5 | 20 |
| Example 8 | Cleaning Blade 8 | 1 | 2 | 90 | 6 | 30 |
| Example 9 | Cleaning Blade 9 | 1 | 7 | 400 | 7 | 20 |
| Comparative Example 1 | Cleaning Blade 10 | 1 | — | — | — | — |
| Comparative Example 2 | Cleaning Blade 11 | 2 | — | — | 5 | 5 |
| Comparative Example 3 | Cleaning Blade 12 | 1 | 1 | 400 | — | — |
| Comparative Example 4 | Cleaning Blade 13 | 2 | 1 | 400 | 5 | 30 |

| | | Surface Layer Thickness [μm] | Surface Layer Roughness Ra [μm] | Tack maximum Value [gf/mm$^2$] | Tack maximum Value of 5 μm inner surface [gf/mm$^2$] | Microscopic Hardness HM at 20 μm [N/mm$^2$] |
|---|---|---|---|---|---|---|
| Example 1 | Cleaning Blade 1 | 1.8 | 0.46 | 0.5 | 2.5 | 2.7 |
| Example 2 | Cleaning Blade 2 | 0.7 | 0.62 | 0.005 | 0.9 | 14.8 |
| Example 3 | Cleaning Blade 3 | 4.8 | 0.23 | 2.3 | 3.4 | 0.9 |
| Example 4 | Cleaning Blade 4 | 1.2 | 0.14 | 2.8 | 6.0 | 1.2 |
| Example 5 | Cleaning Blade 5 | 5.3 | 0.92 | 1.5 | 2.3 | 17.6 |
| Example 6 | Cleaning Blade 6 | — | 0.09 | 3.0 | 4.6 | 1.5 |
| Example 7 | Cleaning Blade 7 | 1.8 | 0.34 | 1.6 | 32.1 | 1.6 |
| Example 8 | Cleaning Blade 8 | 0.3 | 0.38 | 0.8 | 8.6 | 4.5 |
| Example 9 | Cleaning Blade 9 | 3.7 | 0.85 | 2.6 | 6.4 | 3.4 |
| Comparative Example 1 | Cleaning Blade 10 | — | 0.04 | 34.3 | 40.2 | 0.9 |
| Comparative Example 2 | Cleaning Blade 11 | 1.1 | 0.08 | 4.6 | 37.8 | 0.9 |
| Comparative Example 3 | Cleaning Blade 12 | — | 0.12 | 19.4 | 13.6 | 1.6 |
| Comparative Example 4 | Cleaning Blade 13 | 6.1 | 1.64 | 10.2 | 15.6 | 0.7 |

TABLE 6

| | After 10,000 | | | After 100,000 | | |
|---|---|---|---|---|---|---|
| | Cleanability | Abnormal Noises | Color Registration Error | Cleanability | Abnormal Noises | Color Registration Error |
| Example 1 | Good | Good | Good | Good | Good | Good |
| Example 2 | Good | Good | Good | Good | Good | Good |
| Example 3 | Good | Good | Good | Fair | Good | Good |

TABLE 6-continued

| | After 10,000 | | | After 100,000 | | |
|---|---|---|---|---|---|---|
| | Cleanability | Abnormal Noises | Color Registration Error | Cleanability | Abnormal Noises | Color Registration Error |
| Example 4 | Good | Good | Good | Good | Good | Good |
| Example 5 | Fair | Good | Good | Fair | Good | Good |
| Example 6 | Fair | Good | Good | Fair | Good | Good |
| Example 7 | Good | Good | Good | Good | Good | Fair |
| Example 8 | Good | Good | Good | Good | Good | Fair |
| Example 9 | Good | Good | Good | Fair | Good | Fair |
| Comparative Example 1 | Poor | Poor | Poor | Poor | Poor | Poor |
| Comparative Example 2 | Fair | Poor | Fair | Poor | Poor | Poor |
| Comparative Example 3 | Poor | Poor | Poor | Poor | Poor | Poor |
| Comparative Example 4 | Poor | Poor | Fair | Poor | Poor | Fair |

Each of the cleaning blades of Examples 1 to 9 having an impregnated portion or a surface layer and a tack maximum value not greater than 3.0 [gf/mm$^2$] suppressed the contact portion of the elastic member from moving, had appropriate flexibility to have followability to a photoconductor and good cleanability, and prevented abnormal noises and color registration error.

The contact portion unmodified with the curing position of Comparative Example 1 could not suppress the contact portion of the elastic member from moving, resulting in defective cleaning and abnormal noises. The large tack maximum value interfered with rotation of the photoconductor, resulting in color registration error.

The tack maximum value greater than 3.0 [gf/mm$^2$] of Comparative Examples 2 to 4 caused abnormal noises and color registration error. The large tack maximum value and low Martens hardness of Comparative Example 2 caused the edge ridgeline to be turned over and abraded, resulting in defective cleaning. The large tack maximum value and the large surface roughness of Comparative Example 4 caused the pressure of the contact portion to unevenly be applied to the ridgeline, resulting in defective cleaning.

Having now fully described the invention, it will be apparent to one of ordinary skill in the art that many changes and modifications can be made thereto without departing from the spirit and scope of the invention as set forth therein.

What is claimed is:

1. A cleaning blade, comprising:

an elastic member including a contact portion to contact the surface of a member to be cleaned and remove an extraneous matter adhering to the surface of the member, wherein the contact portion includes a modified portion including at least one of:

an impregnated portion including a first cured material formed of a first curing composition in a thickness direction from the surface of the contact portion; and a surface layer formed of a second curing composition on the surface of the contact portion, and wherein the surface of the modified portion has a tack maximum value not greater than 3.0 gf/mm$^2$, and wherein the modified portion has a tack maximum value not greater than 6.0 gf/mm$^2$ at the depth of 5 μm from an undersurface of the blade.

2. The cleaning blade of claim 1, wherein the surface layer has a thickness of from 0.3 to 5.0 μm.

3. The cleaning blade of claim 1, wherein the modified portion has a surface roughness of from 0.20 to 1.00 μm on an undersurface of the blade.

4. The cleaning blade of claim 1, wherein the elastic member has a Martens hardness of from 1.0 to 15.0 N/mm$^2$ on the surface 20 μm from an edge ridgeline.

5. The cleaning blade of claim 1, wherein each of the first curing composition and the second curing composition includes a (meth)acrylate compound.

6. The cleaning blade of claim 1, wherein the first curing composition includes a (meth)acrylate compound having an alicyclic structure having 6 or more carbon atoms in its molecule.

7. The cleaning blade of claim 1, wherein the second curing composition includes a (meth)acrylate compound having a pentaerythritol structure in its molecule.

8. An image forming apparatus, comprising:

an image bearer;

a charger to charge the surface of the image bearer;

an irradiator to irradiate the surface of the image bearer to form an electrostatic latent image;

an image developer to develop the electrostatic latent image with a toner to form a visible image;

a transferer to transfer the visible image onto a recording medium;

a fixer to fix the visible image on the recording medium; and the cleaning blade according to claim 1 to remove the toner remaining on the image bearer.

9. A process cartridge, comprising:

an image bearer; and the cleaning blade according to claim 1 to remove the toner remaining on the image bearer.

* * * * *